US006009807A

United States Patent [19]

Yoshida et al.

[11] Patent Number: 6,009,807

[45] **Date of Patent: *Jan. 4, 2000**

[54] PRINTING APPARATUS

[75] Inventors: Takumi Yoshida; Keisuke Hirai, both of Kyoto, Japan

[73] Assignee: Dainippon Screen Mfg. Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/049,053

[22] Filed: Mar. 27, 1998

[30] Foreign Application Priority Data

Mar. 28, 1997 [JP] Japan ..... PO9-095024

[51] Int. Cl.[7] ..... B41F 7/06; B41F 7/10

[52] U.S. Cl. ..... 101/177; 101/230

[58] Field of Search ..... 101/177, 183, 101/184, 185, 229, 230, 231, 217, 218, 136, 137, 142, 144, 174, 175; 271/225, 291, 184, 186, 902

[56] References Cited

U.S. PATENT DOCUMENTS

| | | | |
|---|---|---|---|
| 2,733,656 | 2/1956 | Gottsching | 101/175 |
| 2,911,907 | 11/1959 | Davidson . | |
| 4,011,812 | 3/1977 | Lecha . | |
| 4,448,125 | 5/1984 | Kawaguchi et al. . | |
| 5,762,333 | 6/1998 | Sugiyama et al. | 101/230 X |

FOREIGN PATENT DOCUMENTS

| | | |
|---|---|---|
| 0 512 549 B1 | 11/1992 | European Pat. Off. . |
| 59-1260 | 1/1984 | Japan . |
| 3-143634 | 6/1991 | Japan . |
| 3-53115 | 8/1991 | Japan . |
| WO 95/25015 | 9/1995 | WIPO . |

*Primary Examiner*—J. Reed Fisher
*Attorney, Agent, or Firm*—McDermott, Will & Emery

[57] ABSTRACT

A printing apparatus for printing a printing-paper is provided with two plate cylinders each holding a plate, two blanket cylinders coming into contact with the plate cylinders respectively and a single impression cylinder coming into contact with these blanket cylinders. Each plate has two printing areas. The two plate cylinders and the two blanket cylinders have the same diameter, which is twice that of the impression cylinder. The impression cylinder is in contact with a feed cylinder and a removal cylinder, and a reverse cylinder is provided to be in contact with the feed cylinder and the removal cylinder. The printing apparatus performs printing corresponding to one of the printing areas of each plate on a single surface of the printing-paper, reverses the printing-paper, and performs printing corresponding to the remaining printing area of each plate on another surface of the printing-paper. Thus, the printing apparatus can execute two-color printing on both surfaces without exchanging inks, despite its compactness.

20 Claims, 27 Drawing Sheets

PRINTING APPARATUS

BACKGROUND OF THE INVENTION

1. Field of the Invention

The present invention relates to an offset printing apparatus for feeding ink to a plate which is held on a plate cylinder and transferring this ink to a printing-paper which is held on an impression cylinder through a blanket cylinder, and more particularly, it relates to a printing apparatus which can selectively execute single-sided printing and double-sided printing/

2. Description of the Prior Art

For example, Japanese Patent Publication No 3-53115 (1991) describes a printing apparatus which can selectively execute single-sided printing and double-sided printing. The printing apparatus described in this gazette comprises a plurality of printing units each provided with a plate cylinder, a blanket cylinder and an impression cylinder having a diameter twice that of the plate cylinder and the blanket cylinder, and a reverse cylinder having the same diameter as the impression cylinder between each adjacent pair of printing units.

This printing apparatus is adapted to print the front surface of each printing-paper by the first printing unit, thereafter transfer the printing-paper from the impression cylinder to the reverse cylinder from the rear end of the printing-paper thereby reversing the printing-paper, and thereafter print the rear surface of the printing-paper by the next printing unit.

In case of performing four-color printing with inks of yellow (Y), magenta (M), cyan (C) and black (K), for example, four printing units are serially provided on this printing unit.

In case of performing multicolor printing in the conventional printing apparatus described in Japanese Patent Publication No. 3-53115, however, a reverse mechanism having a large-sized reverse cylinder must be provided between each pair of printing units for performing reversal printing on both sides of the printing-paper in arbitrary colors, and hence the printing apparatus is disadvantageously complicated in structure and increased in size.

Further, the conventional printing apparatus described in Japanese Patent Publication No. 3-53115 is adapted to perform printing by successively passing the printing-paper through the respective printing units. Therefore, in case of performing four-color printing by feeding inks of yellow, magenta, cyan and black to four printing units respectively and thereafter performing double-sided printing, for example, it is impossible to print both surfaces of the printing-paper with the inks of the same colors. In order to print both surfaces of the printing-paper with the inks of the same colors, therefore, the printing apparatus must perform double-sided printing after removing the inks, cleaning the printing units and feeding the same colors of inks to the plurality of printing units for exchanging the inks in the respective printing units. Also in case of performing four-color printing after printing both surfaces of the printing-paper with two colors of inks, the inks must be changed on the respective printing units.

SUMMARY OF THE INVENTION

The present invention is directed to a printing apparatus for printing printing-papers with plates. According to the present invention, the printing apparatus comprises: a) a first plate cylinder for holding a first plate, the first plate having a plurality of first printing areas; b) a second plate cylinder for holding a second plate, the second plate having a plurality of second printing areas; c) ink application means for applying first and second ink to the first and second plates held on the first and second plate cylinders, respectively; d) a first blanket cylinder contacting with the first plate cylinder, so that the first ink applied to the first plate is transferred to the first blanket cylinder; e) a second blanket cylinder contacting with the second plate cylinder, so that the second ink applied to the second plate is transferred to the second blanket cylinder; f) feed means for feeding a printing-paper to a predetermined position; g) an impression cylinder for receiving the printing-paper from the feed means at the predetermined position and for impressing a first surface of the printing-paper to the first and second blanket cylinders to transfer the first and second ink onto the first surface of the printing-paper; h) removal means for removing the printing-paper from the impression cylinder; and i) reverse means for receiving the printing-paper from the removal means, and feeding the printing-paper in reverse state to the feed means.

The printing apparatus can execute various types of single-sided and double-sided printing without exchanging inks, despite its compactness.

In an aspect of the present invention, the reverse means receives the printing-paper after printed by part of the plurality of first printing areas and the plurality of second printing areas, and feeds the printing-paper in reverse state, whereby the printing-paper is further printed by other part of the plurality of first printing areas and the plurality of second printing areas.

The printing apparatus can print different images on both surfaces of the printing-paper.

In another aspect of the present invention, the first plate has two first printing areas, the second plate has two second printing areas, and the ink application means comprises: c-1) means capable of applying first part of the first ink to any of the two first printing areas; c-2) means capable of applying second part of the first ink to any of the two first printing areas; c-3) means capable of applying first part of the second ink to any of the two second printing areas; and c-4) means capable of applying second part of the second ink to any of the two second printing areas.

The printing apparatus can print a single surface of a printing-paper in one to four colors and both surfaces in one or two colors without exchanging inks.

In another aspect of the present invention, the removal means comprises a removal cylinder having a gripper for holding one edge of the printing-paper from the impression cylinder, and the reverse means comprises a reverse cylinder having a gripper for holding an opposite edge of the printing-paper from the removal cylinder.

The printing apparatus can reverse the printing-paper with a simple structure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
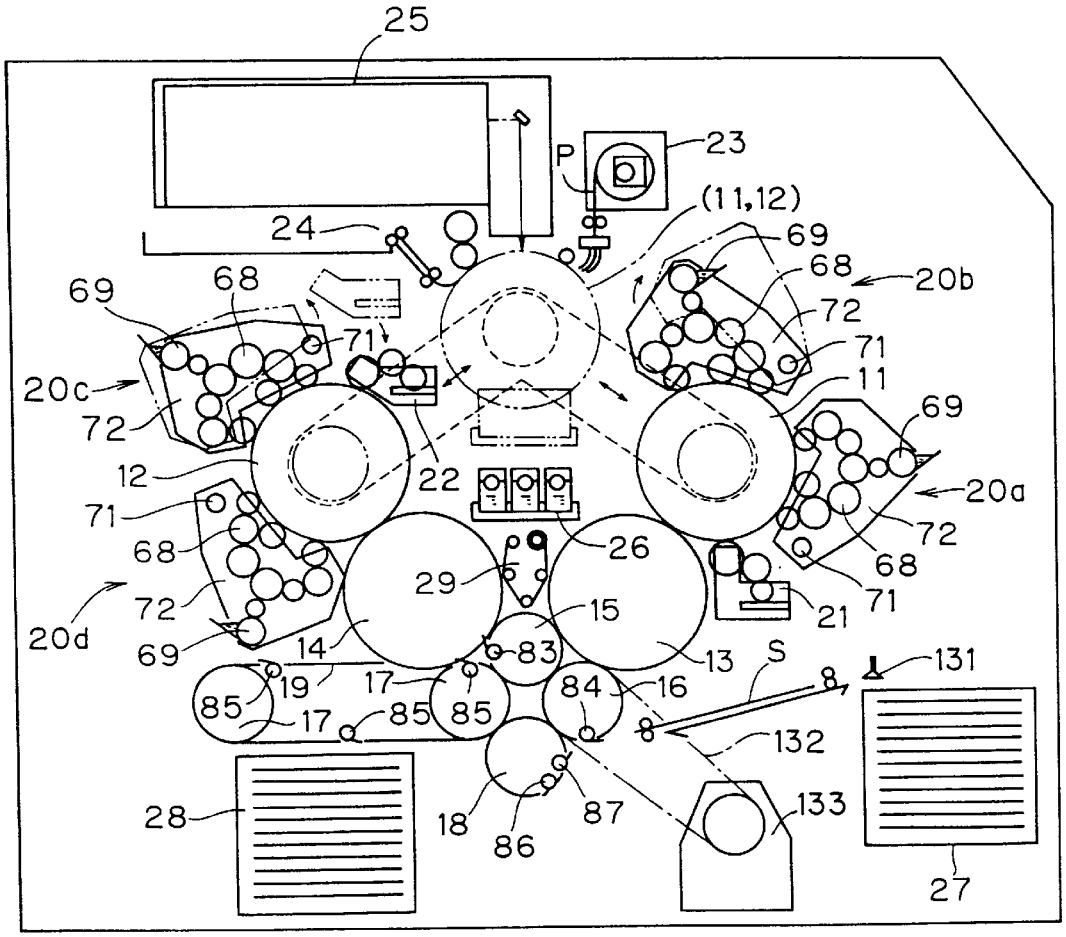
FIG. 1 is a schematic side elevational view of a printing apparatus according to the present invention.

Embodiments of the present invention are now described with reference to the drawings. FIG. 1 is a schematic side elevational view of a printing apparatus according to an embodiment of the present invention.

In this embodiment, the printing apparatus records images on unrecorded plates P which are held on first and second plate cylinders 11 and 12 and thereafter transfers inks fed to the plates P to a printing-paper S which is held on an impression cylinder 15 through first and second blanket cylinders 13 and 14 thereby performing printing.

This printing apparatus is provided with the first plate cylinder 11 which is movable between a first printing position shown by a solid line and an image recording position shown by a two-dot chain line in FIG. 1, and the second plate cylinder 12 which is movable between a second printing position shown by a solid line in FIG. 1 and the aforementioned image recording position.

An ink feeder 20*a* for feeding an ink of black (K), for example, to the plate P, another ink feeder 20*b* for feeding an ink of magenta (M), for example, to the plate P and a damping water feeder 21 for feeding damping water to the plate P are arranged around the first plate cylinder 11 moving to the first printing position. Further, an ink feeder 20*c* for feeding an ink of cyan (C), for example, to the plate P, an ink feeder 20*d* for feeding an ink of yellow (Y), for example, to the plate P, and a damping water feeder 22 for feeding damping water to the plate P are arranged around the second plate cylinder 12 moving to the second printing position. In addition, a plate feed part 23, a plate removal part 24, an image recorder 25 and a developing device 26 are arranged around the first or second plate cylinder 11 or 12 moving to the image recording position.

The printing apparatus is further provided with the first blanket cylinder 13 capable of coming into contact with the first plate cylinder 11, the second blanket cylinder 14 capable of coming into contact with the second plate cylinder 12, the impression cylinder 15 capable of coming into contact with the first and second blanket cylinders 13 and 14 on different positions respectively, a feed cylinder 16 for transferring the printing-paper S fed from a feed part 27 to the impression cylinder 15, a pair of removal cylinders 17 provided with chains 19 extending thereon for removing the printed printing-paper S received from the impression cylinder 15 to a removal part 28, a reverse cylinder 18 for reversing the printing-paper S in double-sided printing, and a blanket scrubber 29.

While the feed cylinder 16 partially forms feed means according to the present invention and the removal cylinder 17 partially forms removal means according to the present invention, these cylinders 16 and 17 can also be regarded as forming reverse means with the reverse cylinder 18.

The aforementioned first and second plate cylinders 11 and 12 are coupled with first and second plate cylinder moving mechanisms 31 and 32 described later respectively, and driven by the first and second plate cylinder moving mechanisms 31 and 32 to reciprocate between the first and second printing positions and the image recording position respectively.

Figure 2:
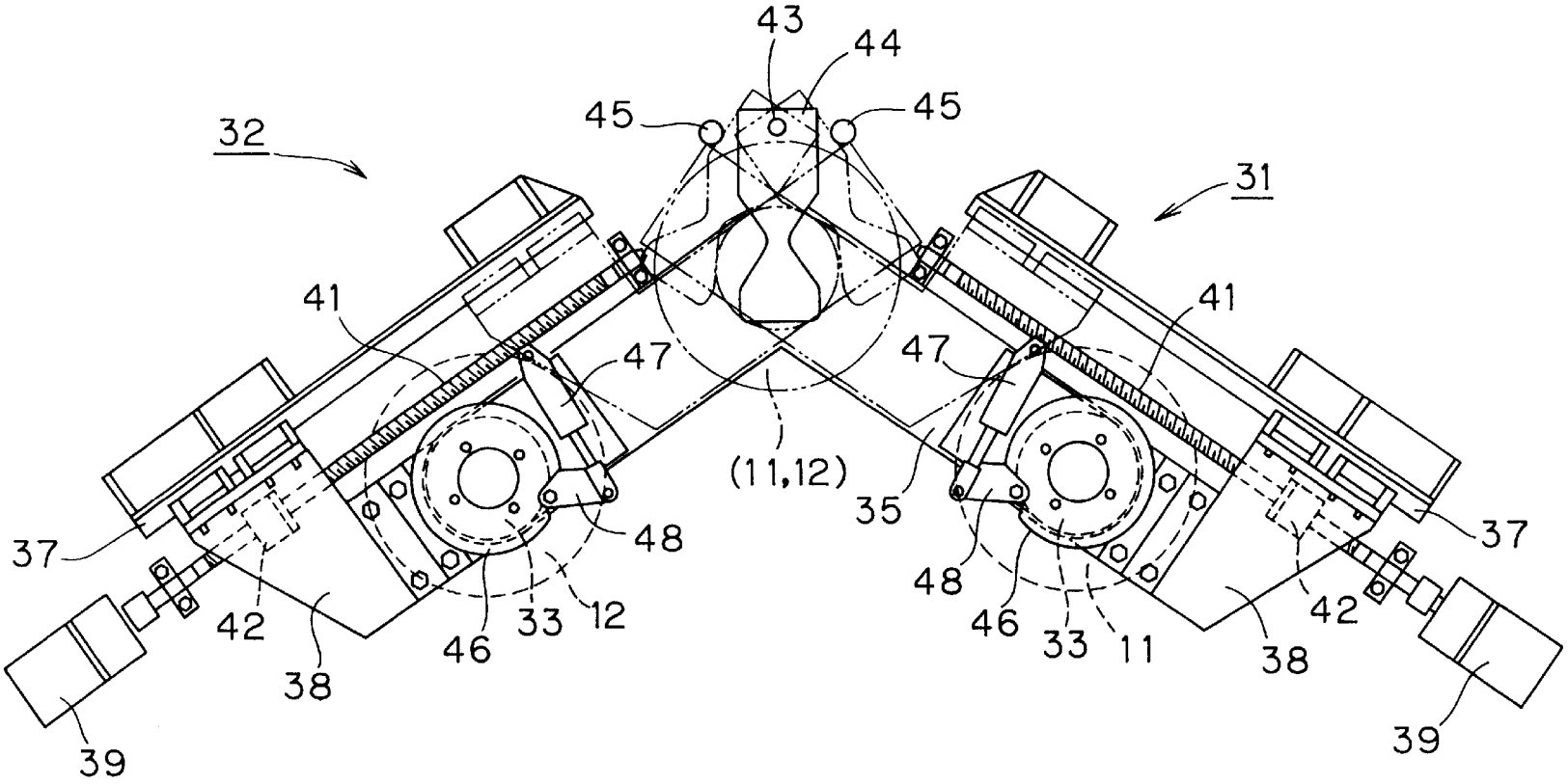
FIG. 2 is a plan view showing first and second plate cylinder moving mechanisms 31 and 32.
Figure 3:
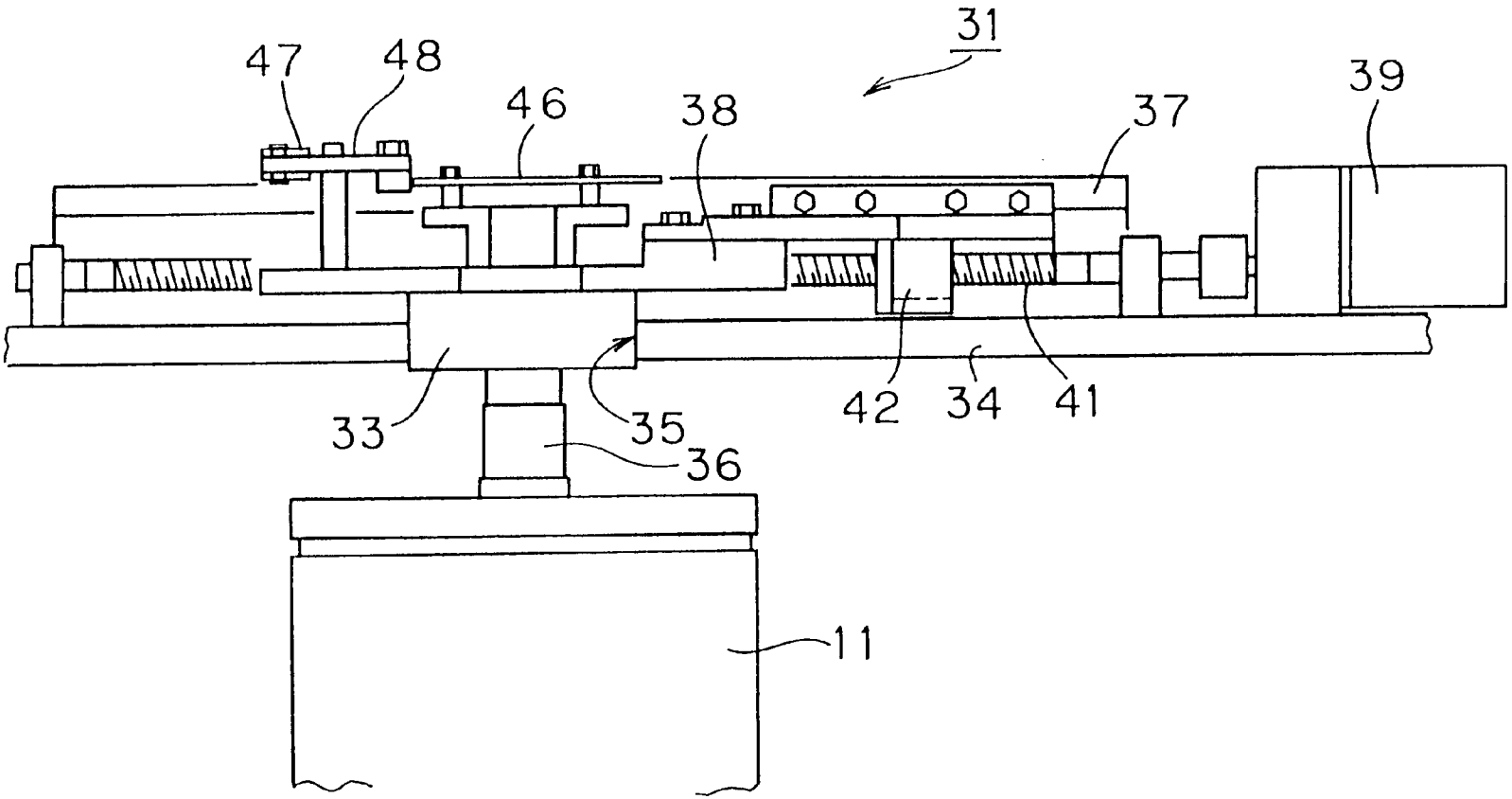
FIG. 3 is a side sectional view of the first plate cylinder moving mechanism 31.

FIG. 2 is a plan view of the first and second plate cylinder moving mechanisms 31 and 32, and FIG. 3 is a side sectional view of the first plate cylinder moving mechanism 31. The first and second plate cylinder moving mechanisms 31 and 32 have similar structures which are symmetrical to each other, and hence common members of the first and second plate cylinder moving mechanisms 31 and 32 are denoted by the same reference numerals.

The first and second plate cylinder moving mechanisms 31 and 32 have groove holes 35 provided on side plates 34, in order to move a pair of bearings 33 pivotally supporting spindles 36 of the first and second plate cylinders 11 and 12 (FIG. 2 shows only the groove holes 35, and omits the side plates 34). Slide holders 38 which are movable along guide members 37 support the bearings 33. The slide holders 38 are provided with nuts 42, which fit with ball screws 41 coupled to drive shafts of motors 39.

Therefore, the first plate cylinder 11 is driven by the motor 39, to be movable with the slide holder 38. The first plate cylinder 11 moves between the first printing position shown by solid and broken lines in FIGS. 1 and 2 respectively and the image recording position shown by two-dot chain lines in FIGS. 1 and 2 along the guide member 37 and the ball screw 41. Similarly, the second plate cylinder 12 is driven by the motor 39, to be movable with the slide holder 38. The second plate cylinder 12 moves between the second printing position shown by solid and broken lines in FIGS. 1 and 2 respectively and the image recording position shown by two-dot chain lines in FIGS. 1 and 2 along the guide member 37 and the ball screw 41.

A stopper 44 rotating about an axis 43 is arranged in the vicinity of the image recording position on each side plate 34. A pair of positioning pins 45 regulate the horizontal moving angle of the stopper 44. The bearing 33 of the first plate cylinder 11 driven by the motor 39 comes into contact with the stopper 44, whereby the first plate cylinder 11 is positioned and fixed on the image recording position. Further, the bearing 33 of the second plate cylinder 12 driven by the motor 39 comes into contact with the stopper 44, whereby the second plate cylinder 12 is positioned and fixed on the image recording position.

In addition, fixing members (not shown) for fixing the bearings 33 of the first and second plate cylinders 11 and 12 are arranged in the vicinity of the first and second printing positions on the side plates 34 respectively. These fixing members position and fix the first and second plate cylinders 11 and 12 on the first and second printing positions respectively.

The bearings 33 of the first and second plate cylinders 11 and 12 are coupled with substantially circular detent members 46 having notches in parts thereof. Further, stop members 48 are arranged on side portions of the detent members 46. These stop members 48 are driven by air cylinders 47, to move between positions for engaging with the notches of the detent members 46 and those for separating from the notches Thus, the stop members 48 driven by the air cylinders 47 engage with the notches of the detent members 46, whereby the first and second plate cylinders 11 and 12 are located on rotational angle positions and fixed thereto.

The detent members 46 and the like are utilized for locating and fixing the first and second plate cylinders 11 and 12 on the rotational angle positions, for the following reason: When the rotational positions of the first and second plate cylinders 11 and 12 and the first and second blanket cylinders 13 and 14 are displaced from each other, this leads to a problem such as misregistration of the printing or collision of the parts. Therefore, these cylinders 11, 12, 13 and 14 must be regularly in constant positional relation to each other. In case of recording images on the plates P which are held on the first and second plate cylinders 11 and 12 on the image recording position by the image recorder 25 described later, rotary encoders (not shown) or the like monitor the rotational angle positions of the first and second plate cylinders 11 and 12. When moving from the image recording position to the first and second printing positions, however, the first and second plate cylinders 11 and 12 may accidentally rotate to cause displacement between the rotational positions of the first and second plate cylinders 11 and 12 and the first and second blanket cylinders 13 and 14. Therefore, the detent members 46 and the like are utilized to locate and fix the first and second plate cylinders 11 and 12 on the rotational angle positions.

The first and second blanket cylinders 13 and 14 are connected with the first and second plate cylinders 11 and 12 moving to the first and second printing positions respectively by gears provided on end portions thereof. When the gears come into contact with each other, therefore, the stop members 48 are separated from the notches of the detent members 46 for rotating and moving the first and second plate cylinders 11 and 12, thereby fitting the gears with each other.

Figure 4:
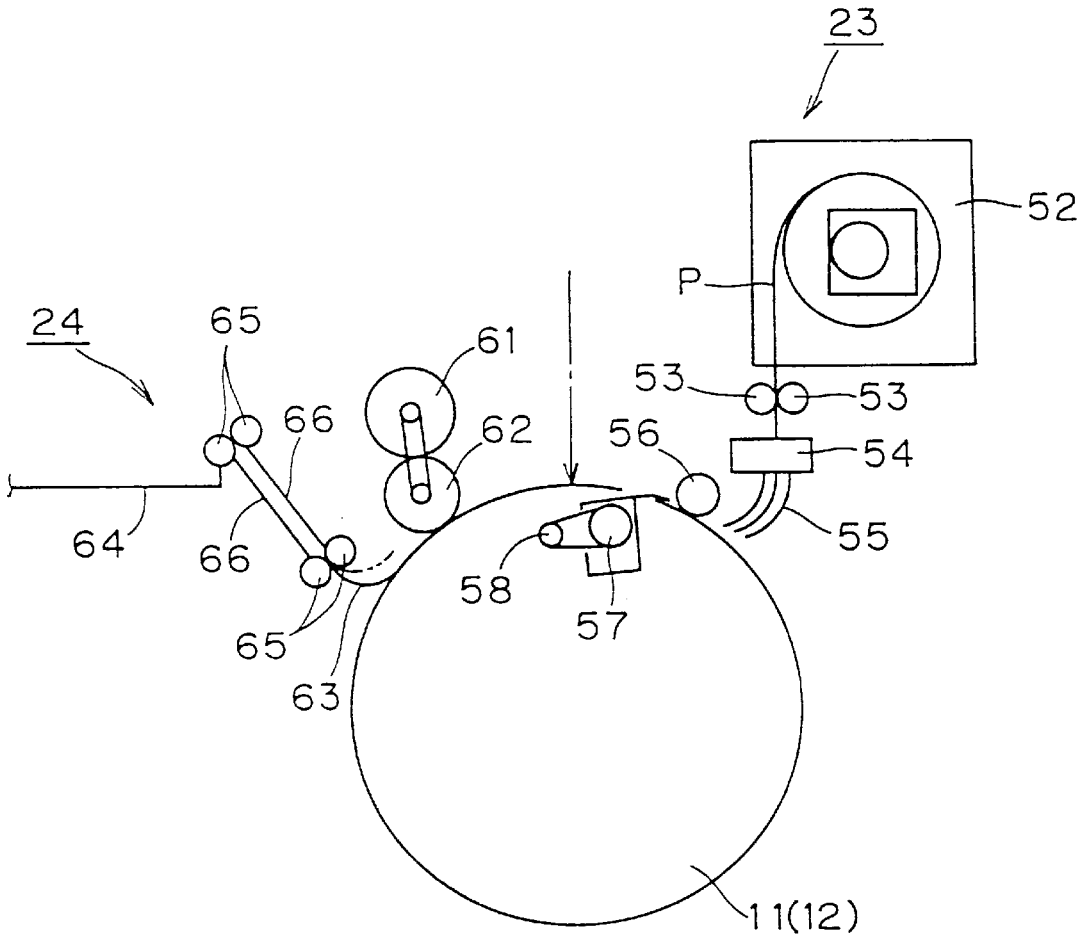
FIG. 4 is a schematic side elevational view showing a first or second plate cylinder 11 or 12 moving to an image recording position with a plate feed part 23 and a plate removal part 24.

As hereinabove described, the plate feed part 23 and the plate removal part 24 are arranged around the first or second plate cylinder 11 or 12 moving to the image recording position. FIG. 4 is a schematic sectional view showing the first or second plate cylinder 11 or 12 moving to the image recording position with the plate feed part 23 and the plate removal part 24.

The plate feed part 23 is provided with a magazine 52 storing a long roll-shaped unrecorded plate P in a high-tight state, a guide member 55 and a guide roller 56 for guiding the forward end portion of the plate P delivered from the magazine 52 by a pair of guide rollers 53 to the surface of the first or second plate cylinder 11 and 12, and a cutter 54 for cutting the long plate p into sheet-type plates P.

Each of the first and second plate cylinders 11 and 12 is provided with a gripper 57 for gripping the forward end of the plate P fed from the plate feed part 23. This gripper 57 brings its cam follower part 58 into contact with a cam (not shown) following rotation of the first or second plate cylinder 11 and 12, thereby performing a switching operation. The first or second plate cylinder 11 or 12 moving to the image recording position comes into contact with a frictional wheel 62 which is driven by a motor 61 to rotate on its surface, and is driven by the motor 61 to rotate at a low speed.

The plate removal part 24 has a pawl 63 for separating the plate P held on the first or second plate cylinder 11 or 12 after completion of printing, and transport rollers 65 and guide members 66 for guiding the plate P separated due to the action of the pawl 63 to a removal tray 64.

The gripper 57 grips the forward end portion of the plate P delivered from the magazine 52 by the pair of guide rollers 53, for winding the plate P on the outer peripheral portion of the first or second plate 11 or 12 following its rotation. A suction device (not shown) provided on the outer peripheral portion of the first or second plate cylinder 11 or 12 sucks and holds the rear end portion of the plate P which is cut by the cutter 54. In this state, the motor 61 drives the first or second plate cylinder 11 or 12 to rotate at a low speed, so that the image recorder 25 irradiates the surface of the plate P held on the outer peripheral portion of the first or second plate cylinder 11 or 12 with a modulated laser beam as described later in detail, for recording the image thereon.

Figure 5A:
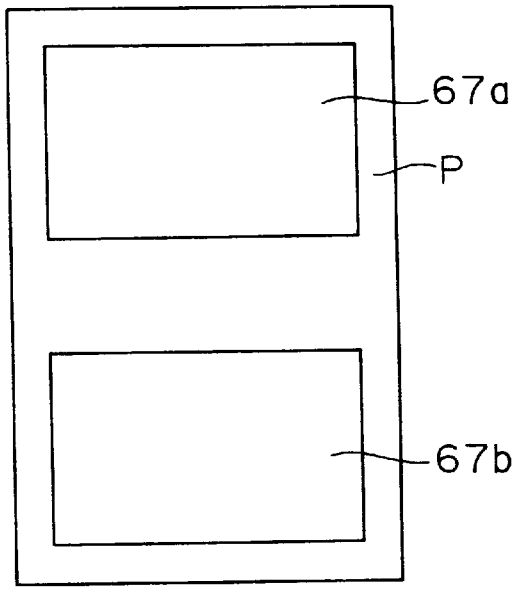
FIGS. 5A and 5B are explanatory diagrams showing arrangement of image areas on a plate P.
Figure 5B:
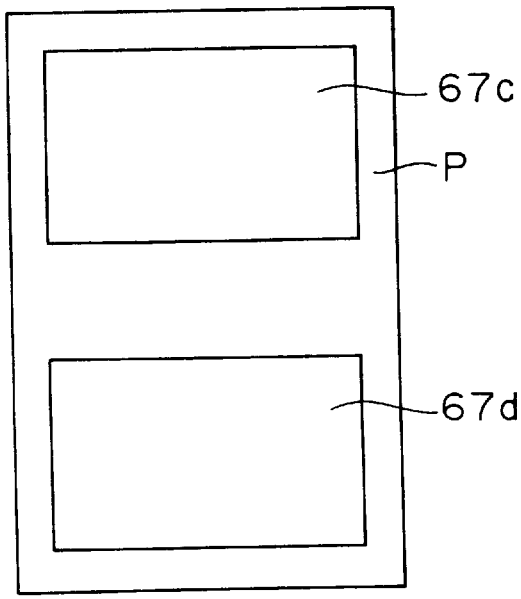

The image recorder 25 records image areas 67*a* and 67*b* on the plate P mounted on the outer peripheral portion of the first plate cylinder 11, as shown in FIG. 5A. On the other hand, the image recorder 25 records image areas 67*c* and 67*d* on the plate P mounted on the outer peripheral portion of the second plate cylinder 12, as shown in FIG. 5B. The image areas 67*a* and 67*b* are recorded on uniformly split positions, i.e., positions separated from each other by 180°, of the plate P in the state mounted on the outer peripheral portion of the first plate cylinder 11. Similarly, the image areas 67*c* and 67*d* are recorded on uniformly split positions, i.e., positions separated from each other by 180°, of the plate P in the state mounted on the second plate cylinder 12.

In case of performing four-color printing on a single surface of the printing-paper S with inks of yellow, magenta, cyan and black, the image areas 67*a*, 67*b*, 67*c* and 67*d* are employed for performing printing with the black, magenta, cyan and yellow inks respectively. In case of performing two-color printing on both surfaces of the printing-paper S with inks of two colors, on the other hand, the image areas 67*a* and 67*b* are employed for printing with the ink of the first color, and the image areas 67*c* and 67*d* are employed for printing with the ink of the second color. In case of performing one-, two- or three-color printing on a single surface or performing monochrome printing on both surfaces, one or two of the image areas 67*a*, 67*b*, 67*c* and 67*d* are not formed.

Figure 6:
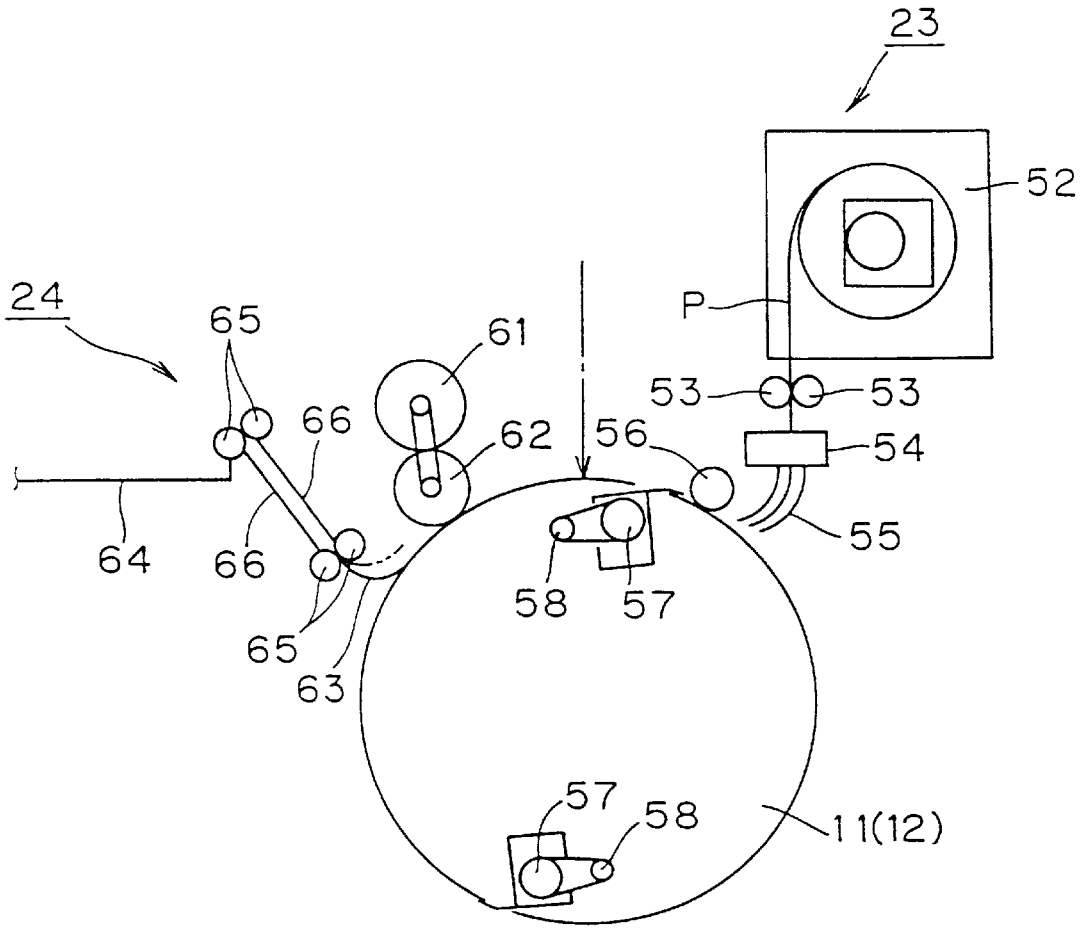
FIG. 6 is a schematic diagram showing the first or second plate cylinder 11 or 12 moving to the image recording position with the plate feed part 23 and the plate removal part 24.

In the aforementioned embodiment, two image areas 67*a* and 67*b* or 67*c* and 67*d* are provided on the single plate P mounted on the outer peripheral portion of the first or second plate cylinder 11 or 12, in order to simplify the structure of the first or second plate cylinder 11 or 12. Alternatively, the first or second plate cylinder 11 or 12 may be provided with two grippers 57 for holding two plates P, as shown in FIG. 6. Also in this case, the first or second plate cylinder 11 or 12 must hold the two plates P in a uniformly split manner so that image areas recorded on each plate P are uniformly split, i.e., separated from each other by 180°.

In case of performing printing on a single surface in one, two or three colors or performing printing on both surfaces in a single color as hereinabove described, no plate P may be arranged on a position corresponding to one or two of the image areas 67*a*, 67*b*, 67*c* and 67*d* shown in FIG. 5.

Figure 7:
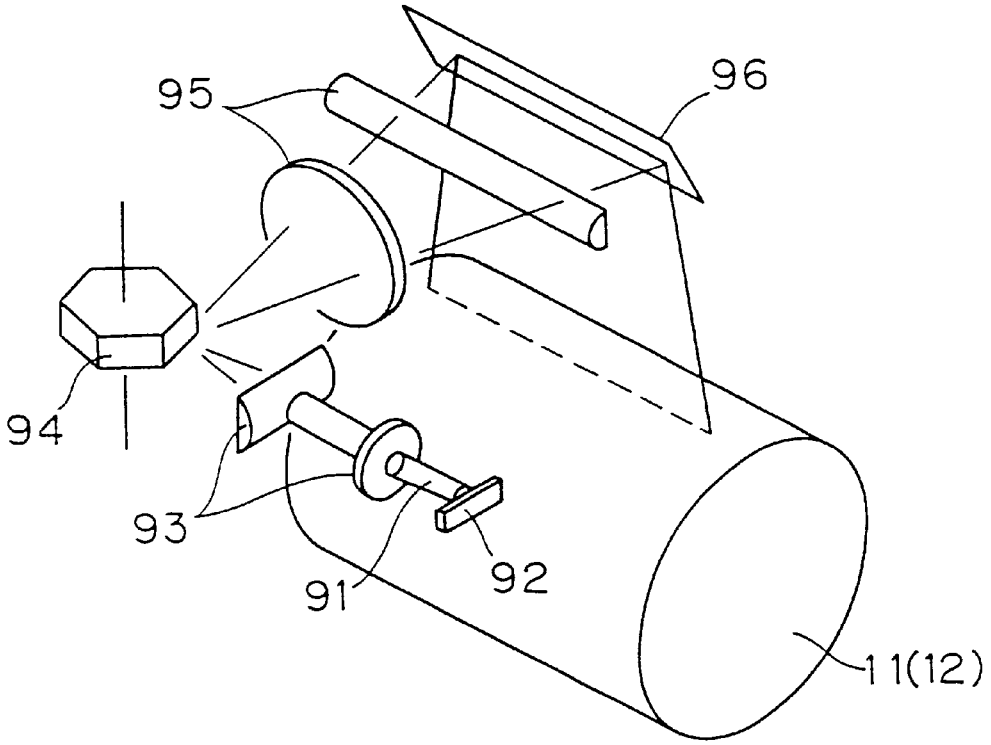
FIG. 7 is a perspective view showing the structure of an image recorder 25.

FIG. 7 is a perspective view showing the structure of the aforementioned image recorder 25.

This image recorder 25 is adapted to scan the plate P moving in a subscanning direction due to rotation of the first or second plate cylinder 11 or 12 moving to the image recording position with a laser beam 91 in a main scanning direction. The image recorder 25 is provided with a semiconductor laser 92 emitting the laser beam 91 as a recording beam modulated on the basis of an image signal, a lens group 93 for converging the laser beam 91 emitted from the semiconductor laser 92, a polygon mirror 94 serving as a deflector, a scanning lens group 95, and a folded mirror 96. The laser beam 91 emitted from the semiconductor laser 92 is deflected by action of the polygon mirror 94 to become a scanning beam directed to the main scanning direction, and scans the overall region of the plate P following movement of the plate P along the subscanning direction, thereby recording a desired image on the plate P.

Referring again to FIG. 1, the ink feeders 20*a* and 20*b* are arranged around the first plate cylinder 11 moving to the first printing position while the ink feeders 20*c* and 20*d* are arranged around the second plate cylinder 12 moving to the second printing position respectively, as hereinabove described. Each of these ink feeders 20*a*, 20*b*, 20*c* and 20*d* (generically referred to as "ink feeder 20") is provided with a plurality of ink roller 68 and an inkwell 69 pivotally supported between a horizontal pair of side plates 72.

The side plate 72 of the ink feeder 20*a* or 20*b* rotate about a shaft 71 due to action of a cam 81 or 82 described later, thereby swinging the ink feeder 20*a* or 20*b*. Due to this swinging, the ink roller 68 of the ink feeder 20*a* or 20*b* come into contact with an arbitrary one of the two image areas 67*a* and 67*b* formed on the plate P held on the outer peripheral portion of the first plate cylinder 11, so that the ink can be fed to only a necessary image area. Similarly, the side plate 72 of the ink feeder 20*c* or 20*d* rotate about a shaft 71 due to action of a cam 81 or 82 described later, thereby swinging the ink feeder 20*c* or 20*d*. Due to this swinging, the ink roller 68 of the ink feeder 20*c* or 20*d* come into contact with an arbitrary one of the two image areas 67*c* and 67*d* formed on the plate P held on the outer peripheral portion of the second plate cylinder 12, so that the ink can be fed to only a necessary image area.

Figure 8:
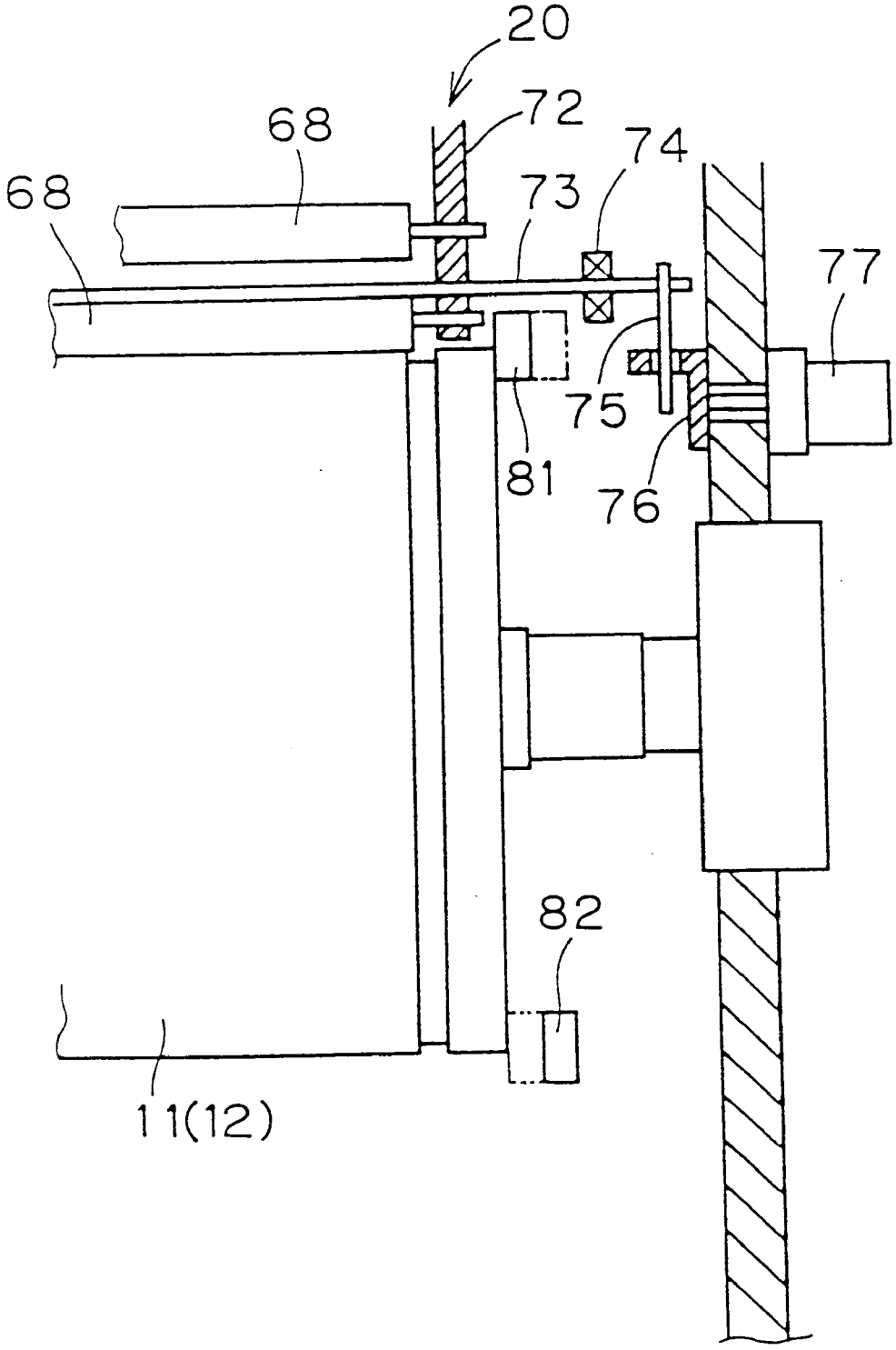
FIG. 8 is a schematic diagram showing a swing mechanism for an ink feeder 20.
Figure 9:
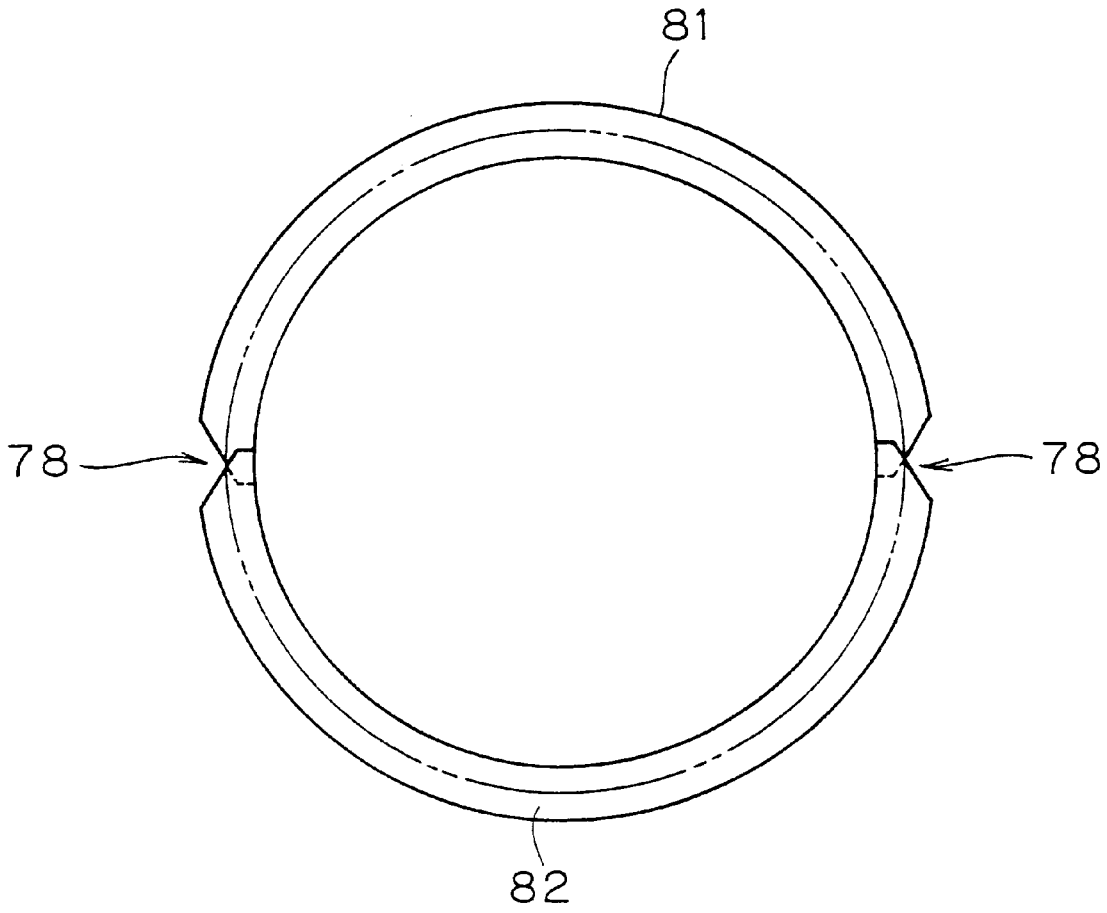
FIG. 9 is a plan view showing cams 81 and 82.

FIG. 8 is a schematic diagram showing a swing mechanism for the aforementioned ink feeder 20, and FIG. 9 is a plan view of the cam 81 or 82.

The cams 81 and 82, having arcuate shapes, are arranged in a positional relation separated from each other by 180° on the side surfaces of the first or second plate cylinder 11 or 12. The positional relation coincides with that of the two image areas 67*a* and 67*b* or 67*c* and 67*d* formed on the plate P.

On the other hand, a spindle 73 slidably passes through the side plates 72 of the ink feeder 20. A bearing 74 serving as a cam follower is provided on an end of the spindle 73. The axial position of the spindle 73 is displaceable through a cylinder mechanism 77 which is connected with the spindle 73 through a coupling rod 75 and an L-shaped fixture 76.

The spindle 73 axially moves in a position where the bearing 74 provided thereon is opposed to concave parts 78 (see FIG. 9) defined by the cam 81 or 82. Following the movement of the spindle 73, the bearing 74 moves between a first position shown by solid lines in FIG. 8, a second position aligned with the cam 81 with respect to the axial direction of the spindle 73, and a third position aligned with the cam 82 with respect to the axial direction of the spindle 73.

When the bearing 74 provided on the spindle 73 is arranged on the first position shown in FIG. 8, the ink rollers 68 of the ink feeder 20 regularly come into contact with the plate P, for feeding the ink to the overall regions of the two image areas 67*a* and 67*b* or 67*c* and 67*d* provided on the plate P.

When arranged on the second position, the bearing 74 provided on the spindle 73 goes up on the cam 81 following rotation of the first or second plate cylinder 11 or 12, whereby the side plates 72 rotate about the shaft 71 to swing the ink feeder 20. At this time, the cam 81 is aligned with the image area 67*a* or 67*c*, whereby the ink rollers 68 of the ink feeder 20 feed the ink only to the remaining image area 67*b* or 67*d* in the two image areas 67*a* and 67*b* or 67*c* and 67*d* provided on the plate P.

When arranged on the third position, the bearing 74 provided on the spindle 73 goes up on the cam 82 following rotation of the first or second plate cylinder 11 or 12, whereby the side plates 72 rotate about the shafts 71 to swing the ink feeder 20. At this time, the ink rollers 68 of the ink feeder 20 feed the ink only to the remaining image area 67*a* or 67*c* in the two image areas 67*a* and 67*b* or 67*c* and 67*d* provided on the plate P.

In case of printing a single surface of the printing-paper S with four color inks of yellow, magenta, cyan and black by this printing apparatus, therefore, the ink feeders 20*a*, 20*b*,

20*c* and 20*d* are supplied with inks of black, magenta, cyan and yellow respectively- The bearings 74 of the ink feeders 20*a* and 20*c* are arranged on the third positions, while those of the ink feeders 20*b* and 20*d* are arranged on the second positions respectively. Thus, the image areas 67*a,* 67*b,* 67*c* and 67*d* can be supplied with the black, magenta, cyan and yellow inks from the ink feeders 20*a,* 20*b,* 20*c* and 20*d* respectively.

In case of performing two-color printing on both surfaces of the printing-paper S in cyan and magenta following the aforementioned single-sided four-color printing, the bearings 74 of the ink feeders 20*b* and 20*c* are arranged on the first positions. On the other hand, driving sources (not shown) swing the side plates 72 of the ink feeders 20*a* and 20*d* about the shafts 71, thereby retreating the ink feeders 20*a* and 20*d* in directions separated from the first and second plate cylinders 11 and 12. Thus, the image areas 67*a* and 67*b* can be supplied with the magenta ink from the ink feeder 20*b,* while the image areas 67*c* and 67*d* can be supplied with the cyan ink from the ink feeder 20*c.*

Among the four ink feeders 20*a,* 20*b,* 20*c* and 20*d,* the ink feeders 20*b* and 20*c* are moved from positions shown by two-dot chain lines in FIG. 1 by driving sources (not shown), to be prevented from interfering with the first and second plate cylinders 11 and 12 during movement thereof. Similarly, the second damping water feeder 22 of the two damping water feeders 21 and 22 is moved by a driving source (not shown) to a position shown by two-dot chain lines in FIG. 1, to be prevented from interfering with the second plate cylinder 12 during its movement.

Referring again to FIG. 1, the damping water feeders 21 and 22 are adapted to feed damping water to the plate P before the same is supplied with the ink by the ink feeder 20. While the damping water feeders 21 and 22 are provided in one-to-one correspondence to the first and second plate cylinders 11 and 12, two such damping water feeders may be provided for each of the first and second plate cylinders 11 and 12- In this case, each damping water feeder feeds damping water only to a corresponding plate, similarly to the aforementioned ink feeder 20.

The aforementioned developing device 26 is arranged under the first or second plate cylinder 11 or 12 moving to the image recording position. This developing device 26 is provided with a developing part, a stabilizing part and a rinsing part, and vertically movable between a standby position shown by solid lines in FIG. 1 and a developing position shown by two-dot chain lines.

In case of developing the plate P on which the image is recorded by the image recorder 25 with the developing device 26, the developing part, the stabilizing part and the rinsing part are successively brought into contact with the plate P driven by the motor 61 shown in FIG. 4 to rotate with the first or second plate cylinder 11 or 12, thereby developing, stabilizing and rinsing the plate P. The developing device 26 may further be provided with a drying part for drying the plate P.

The first and second blanket cylinders 13 and 14 capable of coming into contact with the first and plate cylinders 11 and 12 have the same diameter as the first and second plate cylinders 11 and 12, and blankets for transferring the inks are mounted on the outer peripheral portions thereof. These first and second blanket cylinders 13 and 14 can be freely brought into contact with and separated from the first and second plate cylinders 11 and 12 and the impression cylinder 15 by a contact mechanism described later.

The fist and second blanket cylinders 13 and 14 provided with soft blankets on the outer peripheries thereof are slightly reduced in diameter when coming into contact with the first and second plate cylinders 11 and 12. The aforementioned same diameter also includes slight errors caused by such changes. Further, each of the impression cylinder 15, the feed cylinder 16, the removal cylinder 17 and the reverse cylinder 18 described later have a diameter half that of the first and second plate cylinders 11 and 12 and the first and second blanket cylinders 13 and 14 Also in this case, the diameter includes errors caused on the basis of diameter changes similar to the above.

Figure 10:
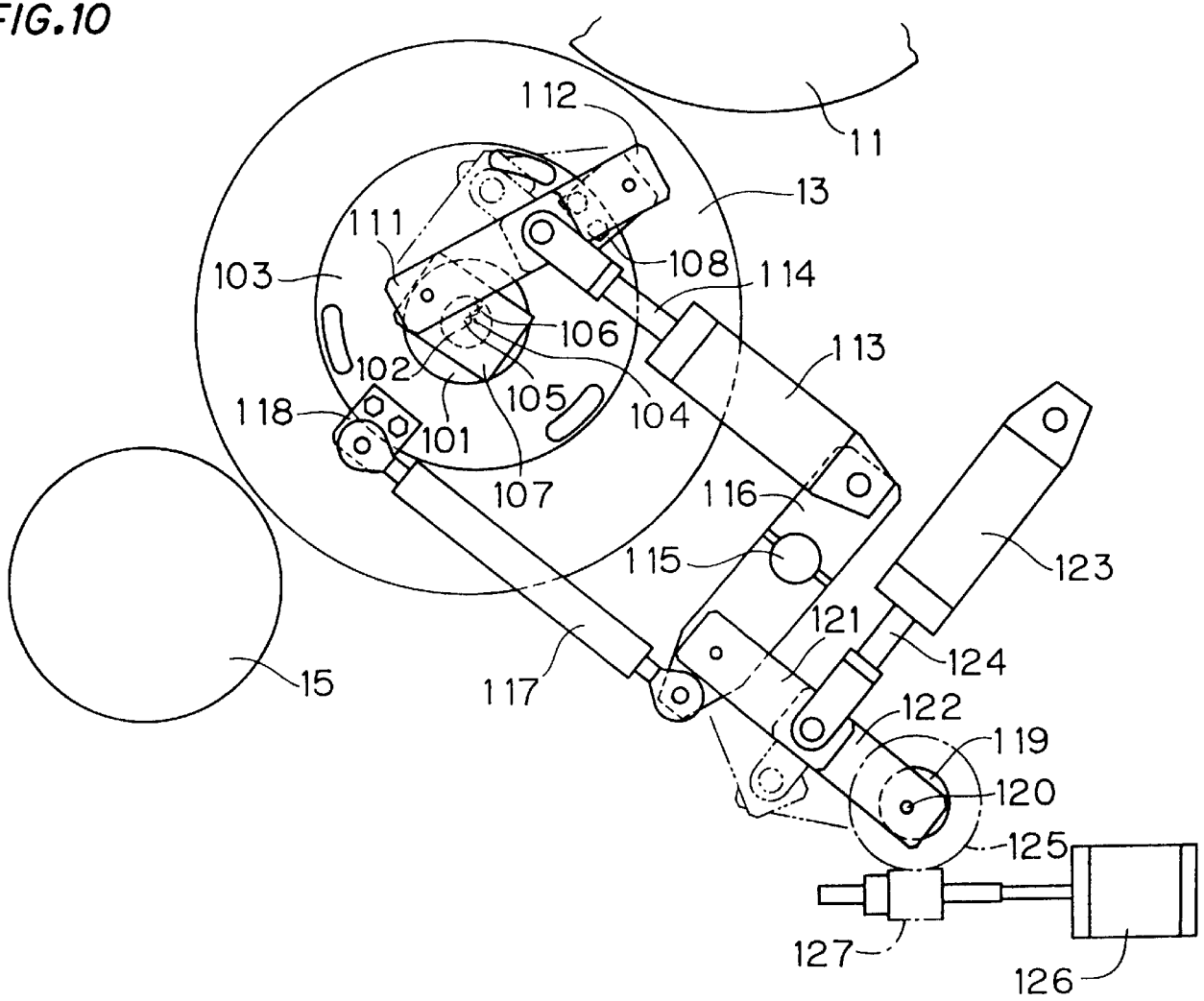
FIG. 10 is a schematic diagram showing a contact mechanism for the first blanket cylinder 11.

FIG. 10 is a schematic diagram showing the contact mechanism for the first blanket cylinder 13. The contact mechanism for the second blanket cylinder 14 is similar in structure to that for the first plate cylinder 13 shown in FIG. 10.

An eccentric shaft 102 decentered from a shaft 101 rotatably supporting the first blanket cylinder 13 is serially provided on a side portion of the shaft 101. Further, an eccentric bearing 103 further decentered from the shafts 101 and 102 is provided around the eccentric shaft 102. As shown in FIG. 10, therefore, the center 104 of the shaft 101, i.e., that of the first blanket cylinder 13, the center 105 of the eccentric shaft 102 and the center 106 of the eccentric bearing 103 are arranged on different positions respectively.

Two coupling plates 111 and 112 forming a link mechanism couple fixed plates 107 and 108 fixedly provided on the eccentric shaft 102 and the eccentric bearing 103 respectively with each other. The forward end portion of a cylinder rod 114 of an air cylinder 113 is connected to the coupled portion of the two coupling plates 111 and 112. The body of the air cylinder 113 is coupled to an end of a rotary plate 116 rotating about a shaft 115. Further, another end of the rotary plate 116 is coupled with a fixed plate 118 fixedly provided on the eccentric bearing 103 through a rod 117.

Further, two coupling plates 121 and 122 forming a link mechanism couple the rotary plate 116 with a shaft 120 of an eccentric member 119. The forward end portion of a cylinder rod 124 of an air cylinder 123 fixed to the apparatus body is connected to the coupled portion of the two coupling plates 121 and 122. A worm wheel 125 connected with the eccentric member 119 fits with a worm gear 127 driven by a motor 126 to rotate.

When the cylinder rods 114 and 124 of the air cylinders 113 and 123 expand in this structure, the surface of the first blanket cylinder 13 separates from those of the first plate cylinder 11 and the impression cylinder 15 by a slight distance, as shown in FIG. 10.

When the air cylinder 113 is driven to contract the cylinder rod 114 in this state, the first blanket cylinder 13 moves toward the first plate cylinder 11 due to action of the link mechanism formed by the two coupling plates 111 and 112, to be in contact with the first plate cylinder 11.

When the air cylinder 123 is driven to contract its cylinder rod 124 in this state, the first blanket cylinder 13 moves toward the impression cylinder 15 due to action of the link mechanism formed by the two coupling plates 121 and 122, to be in contact with the impression cylinder 15. At this time, the rotary plate 116 also rotates clockwise about the shaft 115, whereby the first blanket cylinder 13 moves not only toward the impression cylinder 15 but also toward the first plate cylinder 11. Therefore, the first blanket 13 is maintained in contact with the first plate cylinder 11.

Rotation of the eccentric member 119 results in slight movement of its shaft 120. Thus, the contact pressure between the impression cylinder 15 and the first plate cylinder 11 and the first blanket cylinder 13 can be adjusted by driving the motor 126 to rotate the worm wheel 125 connected with the eccentric member 119 thereby slightly moving the shaft 120. Therefore, the printing pressure in printing with the first blanket cylinder 13 can be adjusted.

Referring again to FIG. 1, the blanket scrubber 29 arranged between the first and second blanket cylinders 13 and 14 is adapted to feed a cleaning solution to long cleaning cloth extended on a path between a delivery roll and a take-up roll through a plurality of pressure rollers for bringing the cleaning cloth into contact with the first and second blanket cylinders 13 and 14 and sliding the same, thereby cleaning the surfaces of the first and second blanket cylinders 13 and 14. The cleaning cloth may further be brought into contact with the surface of the impression cylinder 15, for cleaning the same.

The impression cylinder 15 capable of coming into contact with the first and second blanket cylinders 13 and 14 has the diameter half that of the first and second plate cylinders 11 and 12 and the first and second blanket cylinders 13 and 14, as hereinabove described. Further, the impression cylinder 15 has a gripper 83 for holding and transporting the forward end of the printing-paper S. The printing-paper S passes through the clearance between the impression cylinder 15 and the first and second blanket cylinders 13 and 14, so that any ink is transferred to its surface for printing.

The feed cylinder 16 provided adjacent to the impression cylinder 15 has the same diameter as the impression cylinder 15. A gripper 84 of the feed cylinder 16 holds the forward end portions of printing-papers S which are fed one by one from the paper feed part 27 by a reciprocating suction board 131 and transports the same. The gripper 83 of the impression cylinder 15 holds the forward end of each printing-paper S held by the gripper 84 when the printing-paper S is transferred from the feed cylinder 16 to the impression cylinder 15.

The removal cylinder 17 provided adjacent to the impression cylinder 15 has the same diameter as the impression cylinder 15. The pair of chains 19 are extended on both end portions of the removal cylinder 17, and grippers 85 are arranged on three coupling members (not shown) coupling the pair of chains 19 with each other. When the impression cylinder 15 transfers the printing-paper S to the removal cylinder 17, any gripper 85 of the removal cylinder 17 holds the forward end portion of the printing-paper S held by the gripper 83 of the impression cylinder 15. This printing-paper S is transported onto the removal part 28 following movement of the chains 19, to be removed The reverse cylinder 18 arranged under the impression cylinder 15 has the same diameter as the impression cylinder 15. This reverse cylinder 18 is employed for reversing the printing-paper S in case of performing double-sided printing on the printing-paper S.

Figure 11:
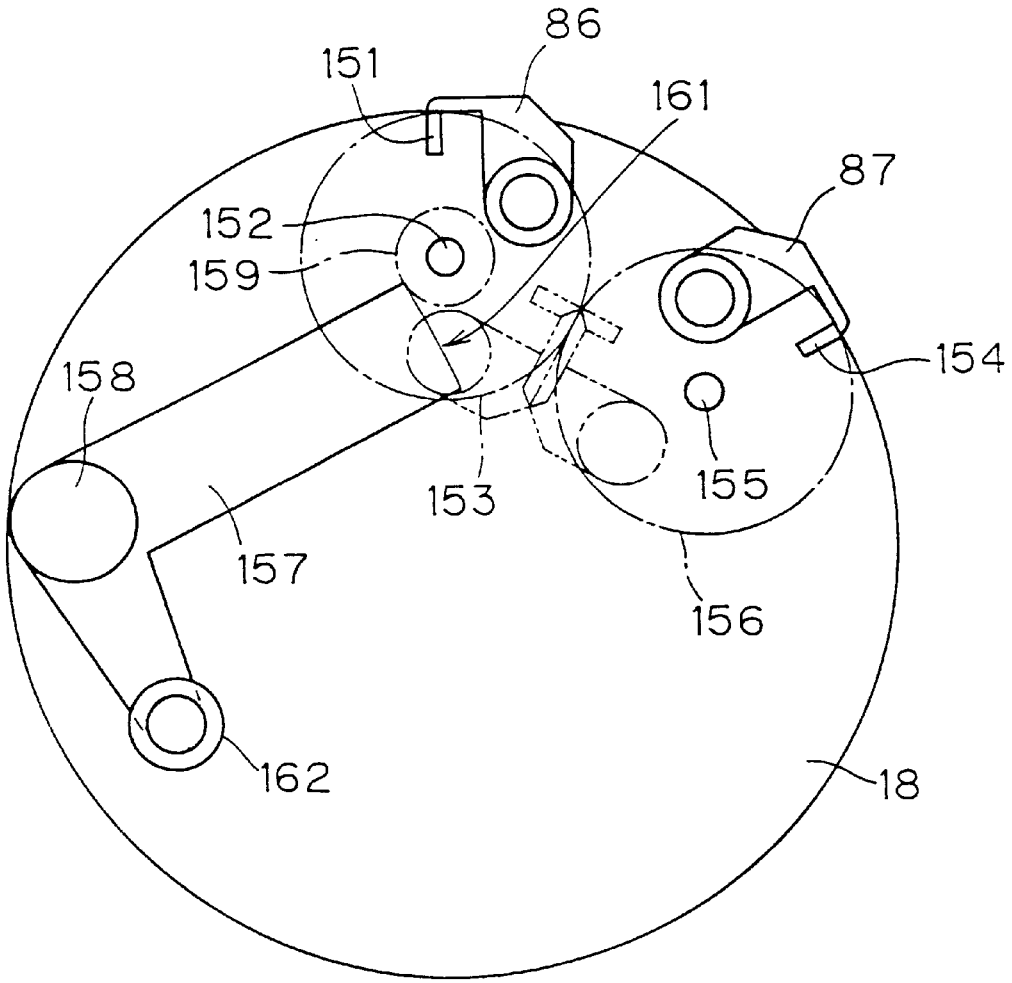
FIG. 11 is a schematic diagram showing a rotation mechanism for grippers 86 and 87 in a reverse cylinder 18.

As shown in FIG. 11, the reverse cylinder 18 is provided with a gripper 86 for rotating while holding the rear end of the printing-paper S held on the outer peripheral portion of the removal cylinder 17, and another gripper 87 for receiving the rear end of the printing-paper S held by the gripper 86 from the gripper 86, rotating and transferring the printing-paper S to the gripper 84 of the feed cylinder 16 from the rear end thereof. A plurality of such grippers 86 and 87 are arranged along the longitudinal direction of the reverse cylinder 18 (perpendicular to the plane of FIG. 11) on different positions not interfering with each other.

A gear 153 which is rotatable about a shaft 152 provided on the reverse cylinder 18 supports the gripper 86 and a base 151 thereof. Another gear 159 is coaxially arranged on the gear 153. A gear 156 which is rotatable about a shaft 155 provided on the reverse cylinder 18 supports the gripper 87 and a base 154 thereof. The gears 153 and 156 fit with each other.

A substantially L-shaped arm 157 is arranged to be swingable about a shaft 158 provided on the reverse cylinder 18. A rack surface 161 is formed on one end portion of this arm 157. This rack surface 161 fits with the gear 159. Further, a cam follower 162 coming into contact with a cam (not shown) is arranged on another end portion of the arm 157.

Thus, the cam follower 162 comes into contact with the cam (not shown) and swings, whereby the grippers 86 and 87 rotate about the axes of the shafts 152 and 155 respectively. When the grippers 86 and 87 move to positions shown by two-dot chain lines in FIG. 11, the gripper 86 transfers the printing-paper S to the gripper 87, as described later.

Cam mechanisms (not shown) open/close the aforementioned grippers 83, 84, 85, 86 and 87 respectively. The grippers 83, 84, 85, 86 and 87 must be opened/closed depending on whether double-sided printing or single-sided printing is performed on the printing-paper S. Similarly, it must be changed whether to perform transfer between the grippers 86 and 87 depending on whether double-sided printing or single-sided printing is performed on the printing-paper S. A control part 140 described later makes instructions for changing the cams to be in contact with the cam followers provided on the grippers 83, 84, 85, 86 and 87 and the cam follower 162 provided on the end portion of the arm 157.

In place of the aforementioned cam mechanisms, other actuators such as air cylinders or motors may open/close the grippers 83, 84, 85, 86 and 87 and transfer the printing-paper S by the grippers 86 and 87.

As hereinabove described, the feed cylinder 16, the removal cylinder 17 and the reverse cylinder 18 form printing-paper reverse means for receiving the printing-paper S completely printed on its first surface from the impression cylinder 15, reversing the printing-paper S and transferring the same to the impression cylinder 15 again in case of performing double-sided printing by this printing apparatus.

The reverse operation for the printing-paper S is now described. FIGS. 12A to 14B are explanatory diagrams showing the reverse operation for the printing-paper S by the printing-paper reverse mechanism. FIGS. 12A to 14B partially omit the grippers 83, 84 and 85 of the feed cylinder 16 and the removal cylinder 17, for simplifying the illustration.

Figure 12A:
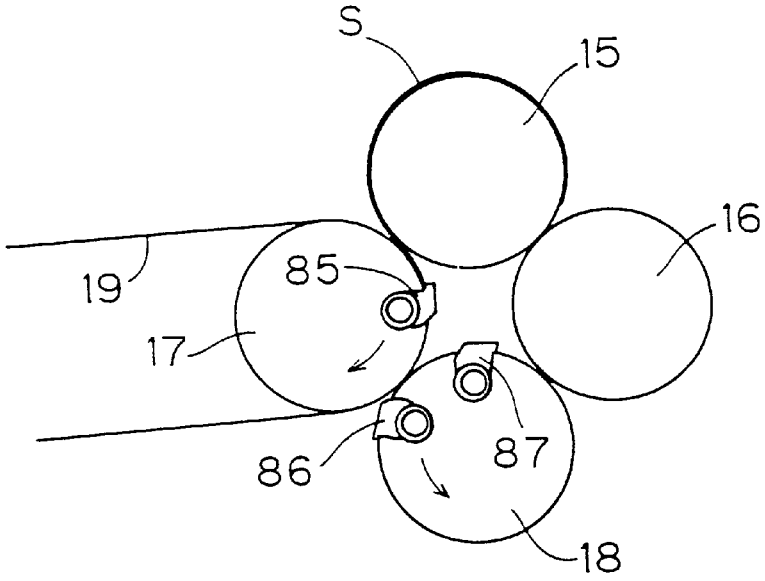
FIGS. 12A and 12B are explanatory diagrams showing a reversing operation for a printing-paper S by a printing-paper reverse mechanism.
Figure 12B:
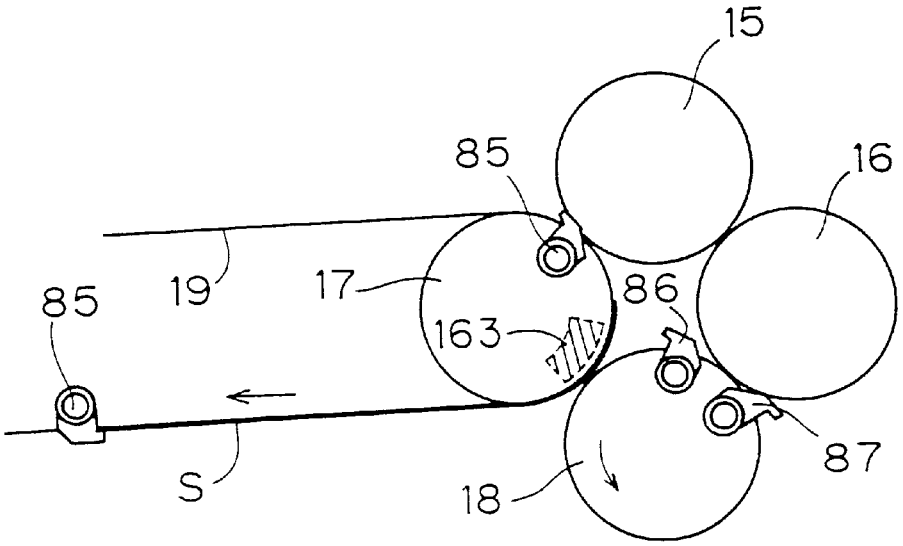

The gripper 85 of the removal cylinder 17 holds the forward end portion of the printing-paper S passing through the clearance between the impression cylinder 15 and the first and second blanket cylinders 13 and 14 to be printed, as shown in FIG. 12A. The gripper 85 moves with the chains 19 as shown in FIG. 12B, thereby transporting the printing-paper S along the chains 19. A sucking mechanism 163 provided on the removal cylinder 17 sucks the rear end portion of the printing-paper S, and holds the same on the surface of the removal cylinder 17.

Figure 13A:
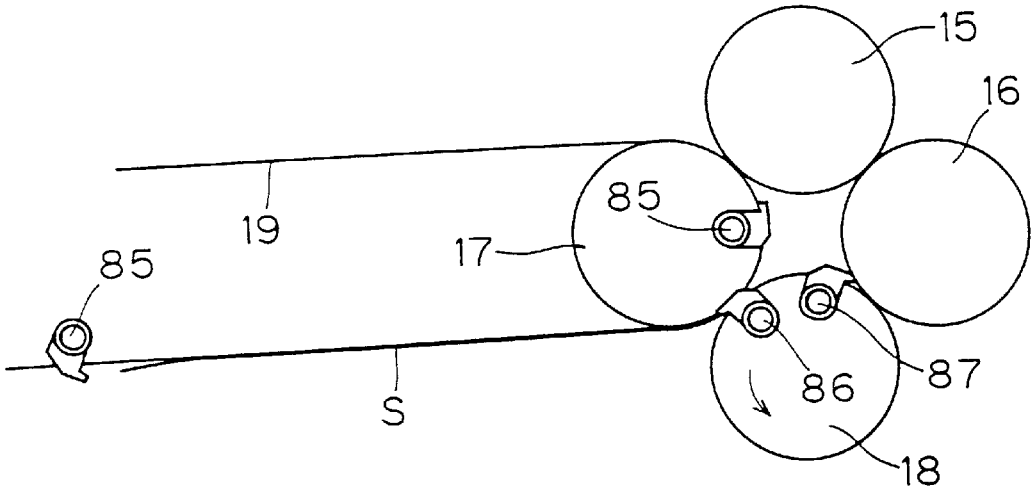
FIGS. 13A and 13B are explanatory diagrams showing the reversing operation for the printing-paper S by the printing-paper reverse mechanism.
Figure 13B:
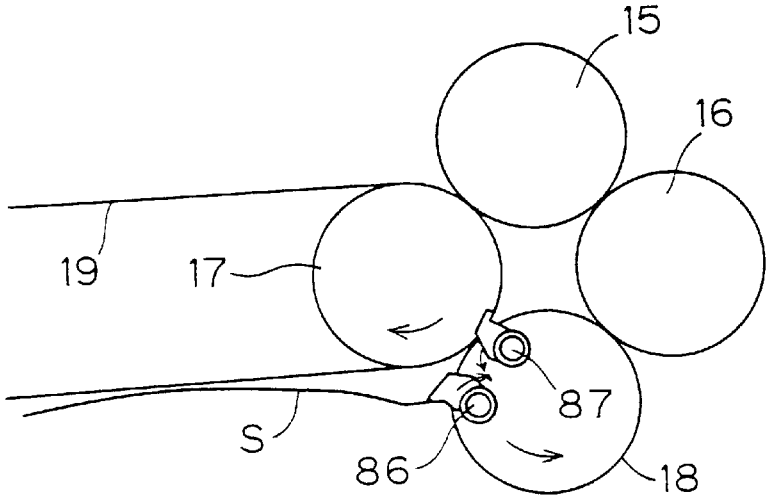

Then, the gripper 86 of the reverse cylinder 18 holds the rear end portion of the printing-paper S, as shown in FIG. 13A. Then, the removal cylinder 17 transfers the printing-paper S to the reverse cylinder 18 following rotation of the reverse cylinder 18, as shown in FIG. 13B.

Figure 14A:
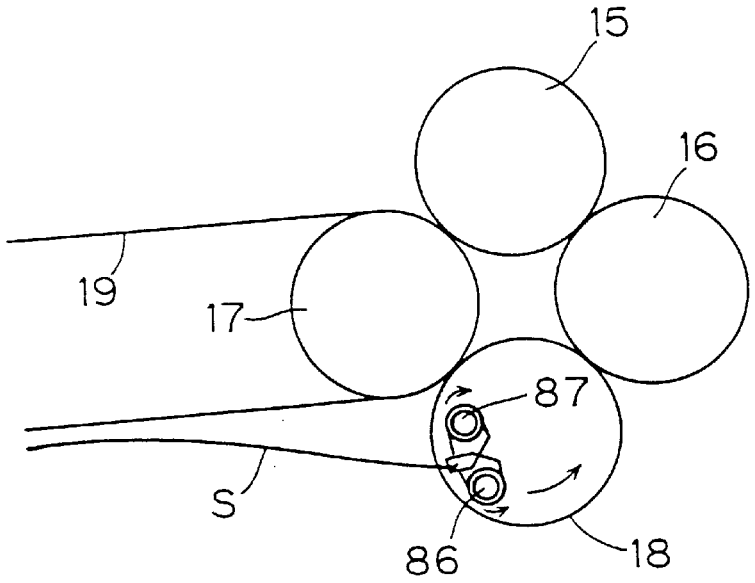
FIGS. 14A and 14B are explanatory diagrams showing the reversing operation for the printing-paper S by the printing-paper reverse mechanism.
Figure 14B:
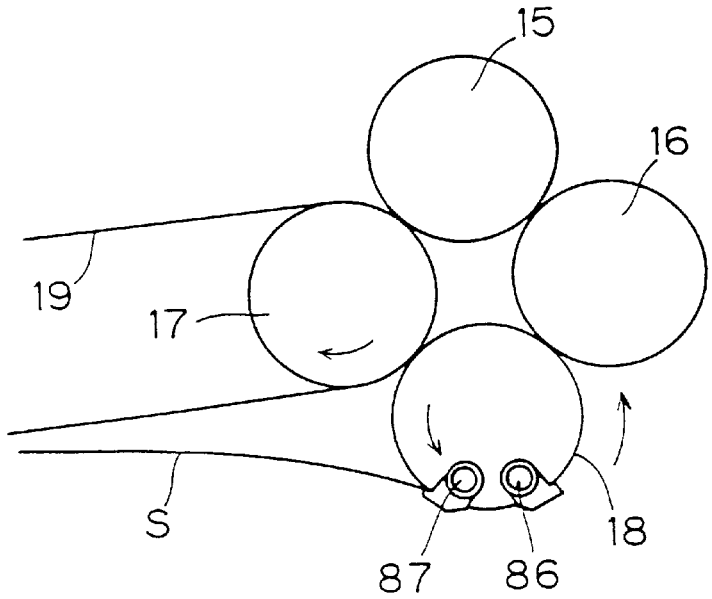

During the rotation of the reverse cylinder 18, the cam follower 162 of the arm 157 provided on the reverse cylinder 18 comes into contact with the cam (not shown), thereby swinging the arm 157. Thus, the grippers 86 and 87 rotate to transfer the printing-paper S therebetween as shown in FIG. 14A. The reverse cylinder 18 further continuously rotates, whereby the gripper 87 holds the printing-paper S from its rear end portion, and transports the same toward the feed cylinder 16, as shown in FIG. 14B. The printing-paper S is fed to the impression cylinder 15 through the feed cylinder 16, similarly to a printing-paper S newly fed from the feed part 27.

As hereinabove described, the printing-paper S is reversed when successively passing through the impression cylinder 15, the removal cylinder 17, the reverse cylinder 18 and the feed cylinder 16 to be transferred to the impression cylinder 15 again.

When the impression cylinder 15 holds the rear end of the printing-paper S on its outer peripheral portion again, the position of the printing-paper S lags that of the printing-paper upon separation of the forward end from the outer peripheral portion of the impression cylinder 15 in phase by a distance twice the outer periphery of the impression cylinder 15. After reversed, therefore, the printing-paper S is transferred to a position on the impression cylinder 15 which lags in phase by the same distance as the outer periphery of the first or second plate cylinder 11 or 12 on the impression cylinder 15.

Referring again to FIG. 1, the feed cylinder 16 is coupled to a motor 133 through a belt 132. The feed cylinder 16, the impression cylinder 15, the removal cylinder 17, the reverse cylinder 18 and the first and second blanket cylinders 13 and 14 are coupled with each other by gears provided on end portions thereof respectively. Further, the first and second blanket cylinders 13 and 14 are coupled with the first and second plate cylinders 11 and 12 moving to the first and second printing positions respectively by gears provided on end portions thereof Thus, the motor 133 is so driven as to rotate the feed cylinder 16, the impression cylinder 15, the removal cylinder 17, the reverse cylinder 18, the first and second blanket cylinders 13 and 14 and the first and second plate cylinders 11 and 12 in synchronization with each other.

Also when the surfaces of the first and second blanket cylinders 13 and 14 are slightly separated from those of the first and second plate cylinders 11 and 12 and the impression cylinder 15 due to action of the contact mechanisms for the first and second blanket cylinders 13 and 14 shown in FIG. 10, the gears provided on the end portions of the first and second blanket cylinders 13 and 14, the first and second plate cylinders 11 and 12 and the impression cylinder 15 engage with each other in the range of teeth thereof respectively, to be capable of transmitting rotational driving force thereof.

Figure 15:
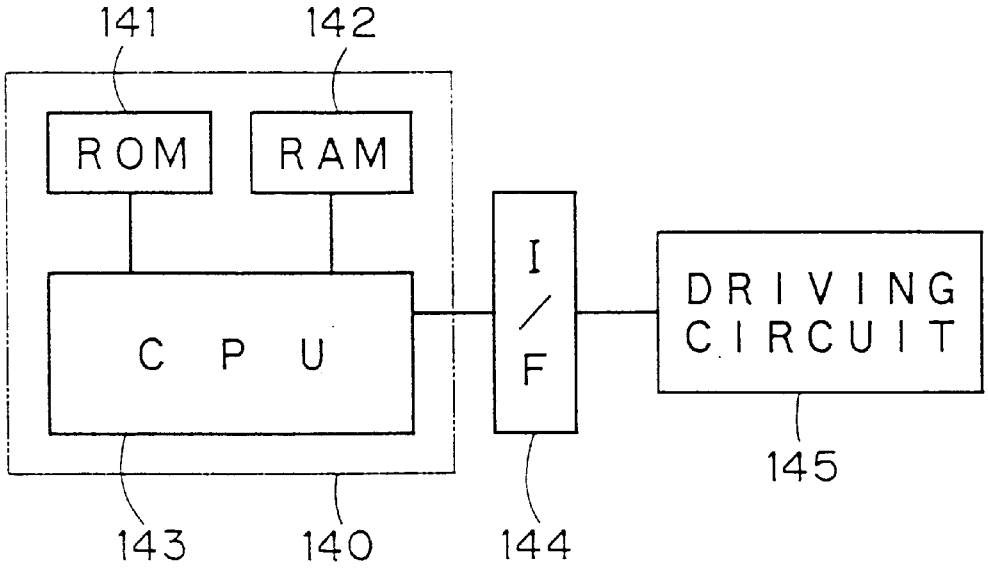
FIG. 15 is a block diagram showing the principal electrical structure of the printing apparatus.

FIG. 15 is a block diagram showing the principal electrical structure of the printing apparatus. This printing apparatus comprises a control part 140 consisting of a ROM 141 storing operation programs necessary for controlling the apparatus, a RAM 142 temporarily storing data and the like in control, and a CPU 143. The control part 140 is connected with a driving circuit 145 generating driving signals for the ink feeder 20, the image recorder 25, the developing device 26, the blanket scrubber 29, the first and second plate cylinder moving mechanisms 31 and 32, driving parts in the contact mechanisms for the first and second blanket cylinders 13 and 14 and the motor 133 through an interface 144. The printing apparatus is controlled by the control part 140, to execute prepress and printing operations described later.

The control part 140 also serves as control means for selectively driving the printing-paper reverse means for reversing the printing-paper S at need, as hereinabove described.

Figure 16:
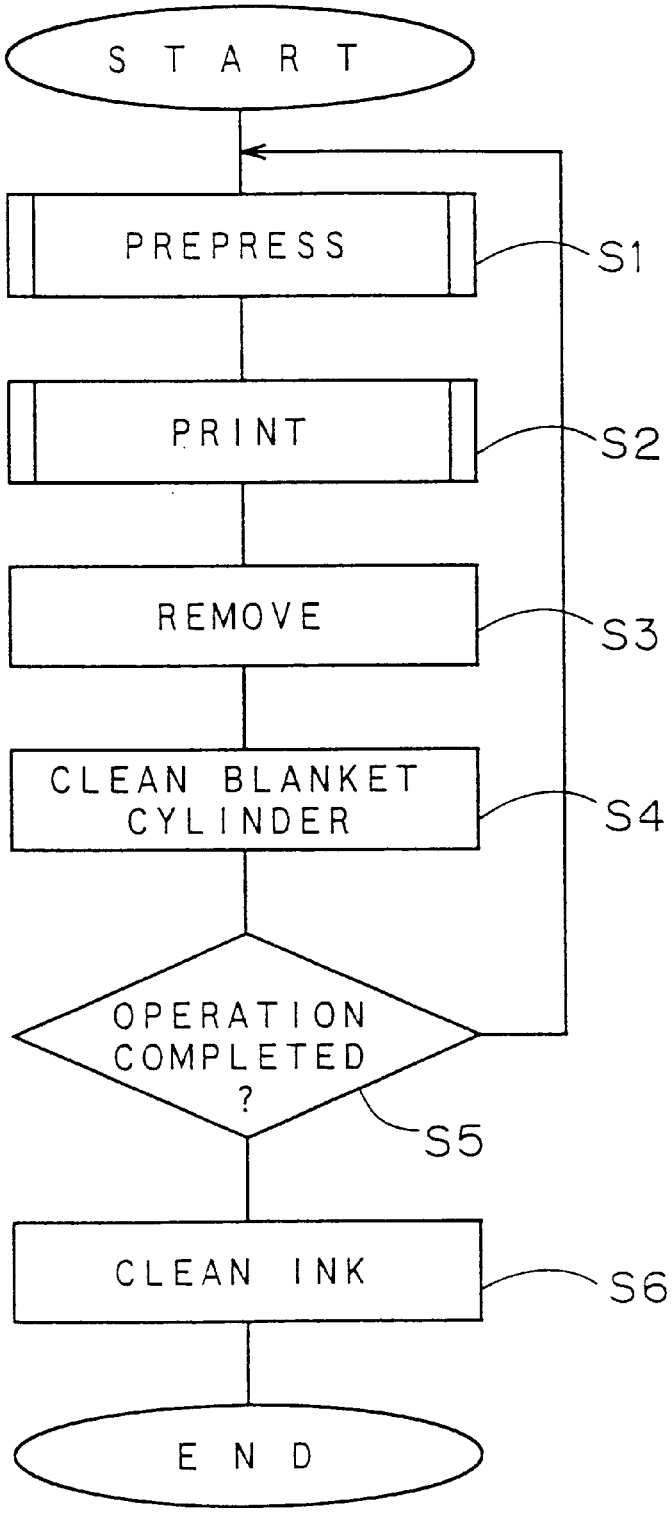
FIG. 16 is a flow chart showing the outline of prepress and printing operations by the printing apparatus.

The prepress and printing operations of the printing apparatus are now described. FIG. 16 is a flow chart schematically showing the prepress and printing operations of the printing apparatus.

Figure 17:
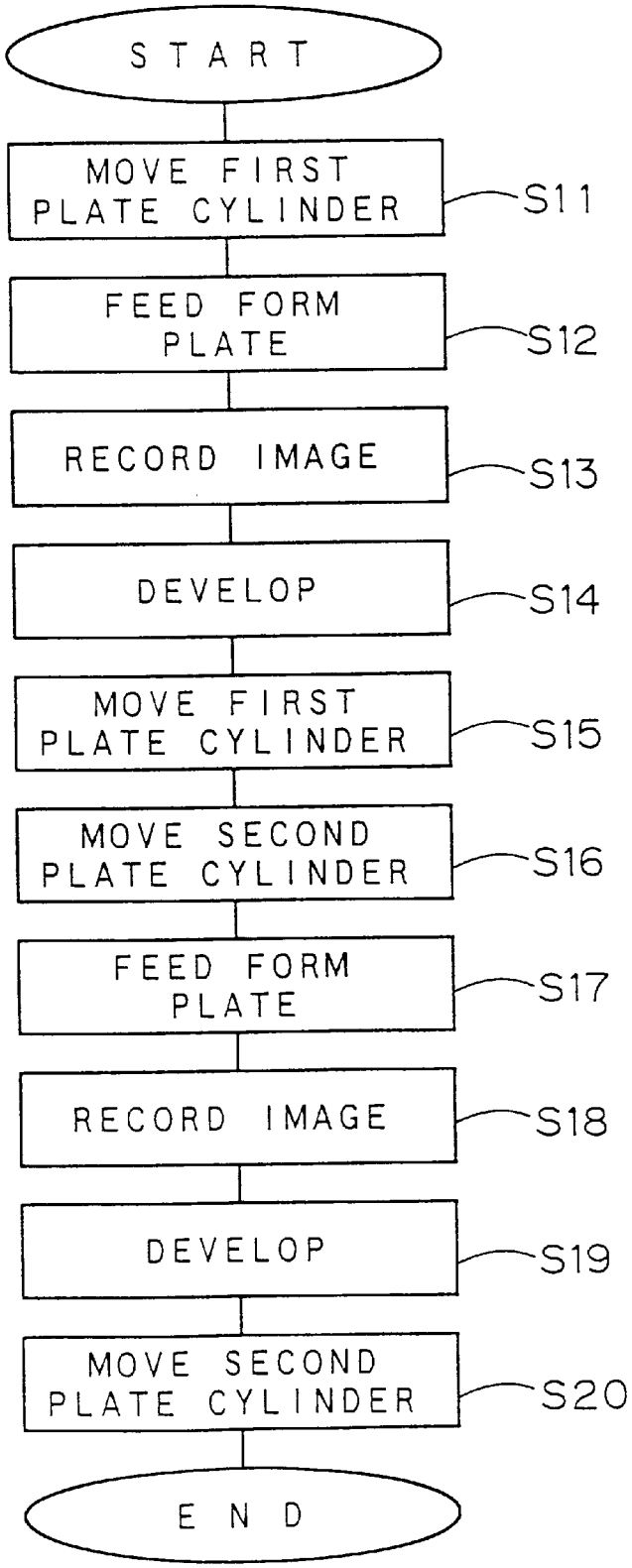
FIG. 17 is a flow chart showing prepress steps.

First, the printing apparatus executes a prepress step of recording images on the plates P and developing the same on the first and second plate cylinders 11 and 12 (step S1). The printing apparatus executes this prepress step in accordance with a subroutine including steps shown in a flow chart of FIG. 17.

First, the printing apparatus moves the first plate cylinder 11 to a prepress position shown by the two-dot chain line in FIG. 1 (step S11). The motor 39 shown in FIG. 2 is driven to move the slide holder 38 along the guide member 37, thereby moving the first plate cylinder 11.

Then, the printing apparatus supplies the plate P to the outer periphery of the first plate cylinder 11 (step S12). The gripper 57 grips the head portion of the plate P delivered from the magazine 52 by the pair of guide rollers 53 shown in FIG. 4 so that the suction device (not shown) sucks and holds the rear end portion of the plate P cut by the cutter 54, thereby feeding the plate P.

Then, the printing apparatus records an image on the plate P held on the outer periphery of the first plate cylinder 11 (step S13). The printing apparatus records the image by driving the motor 61 for rotating the first plate cylinder 11 at a low speed while applying a modulated laser beam to the plate P held on the outer periphery of the first plate cylinder 11 from the image recorder 25.

Then, the printing apparatus develops the plate P on which the image is recorded (step S14). The printing apparatus upwardly moves the developing device 26 to the developing position shown by two-dot chain lines in FIG. 1, and thereafter successively brings the developing part, the stabilizing part and the rinsing part into contact with the first plate cylinder 11 rotated at a low speed, for performing the development.

After completion of the development, the printing apparatus moves the first plate cylinder 11 to the first printing position shown by the solid line in FIG. 1 (step S15).

Then, the printing apparatus executes the prepress step for the plate P held on the outer periphery of the second plate cylinder 12 similarly to the steps S11 to S15 (steps S16 to S20).

After completion of the prepress step on the plates P held on the outer peripheries of the first and second plate cylinders 11 and 12, the printing apparatus ends the prepress step.

Referring again to FIG. 16, the printing apparatus executes a printing step of printing the printing-papers S with the plates P mounted on the first and second plate cylinders 11 and 12 (step S2). The operation of the printing apparatus in this printing step is described later in detail.

After completion of the printing step, the printing apparatus removes the plates P used for the printing (step S3). In order to remove the plates P, the printing apparatus first moves the first plate cylinder 11 to the prepress position shown by the two-dot chain line in FIG. 1. Then, the printing apparatus drives the motor 61 shown in FIG. 4 for rotating the first plate cylinder 11 anticlockwise while separating an end portion of the plate P from the first plate cylinder 11, and guides the plate P through the transport roller 65 and the guide member 66, for removing the same on the removal tray 64. The printing apparatus returns the first plate cylinder 11 to the first printing position, and then moves the second plate cylinder 12 from the second printing position to the prepress position for executing an operation similar to the above, thereby removing the plate P held on the second plate cylinder 12 onto the removal tray 64.

After completion of the plate removal step, the printing apparatus cleans the first and second blanket cylinders 13 and 14 (step S4). The printing apparatus separates the first and second blanket cylinders 13 and 14 from the first and second plate cylinders 11 and 12 and the impression cylinder 15 by the contact mechanism shown in FIG. 10 and thereafter rotates the first and second blanket cylinders 13 and 14, in order to clean the same. In this state, the printing apparatus brings the cleaning cloth supplied with the cleaning solution in the blanket scrubber 29 into contact with the surfaces of the first and second blanket cylinders 13 and 14 and slides the same, thereby cleaning the first and second blanket cylinders 13 and 14.

After completely cleaning the first and second blanket cylinders 13 and 14, the printing apparatus confirms whether or not another printed matter is to be printed (step S5). If the determination is of YES, the printing apparatus repeats the operations at the steps S1 to S4.

If the printing operation is ended, the printing apparatus cleans the inks (step S6). The printing apparatus removes the inks adhering to the ink rollers 68 and the inkwell 69 of the ink feeder 20 and cleans the same with an ink scrubber (not shown) arranged on the ink feeder 20.

After completion of the ink cleaning step, the printing apparatus ends all steps.

The printing apparatus according to the aforementioned embodiment comprises the first plate cylinder moving mechanism 31 for moving the first plate cylinder 11 between the image recording position opposed to the image recorder 25 and the first printing position to be in contact with the first blanket cylinder 13 and the second plate cylinder moving mechanism 32 for moving the second plate cylinder 12 between the image recording position and the second printing position to be in contact with the second blanket cylinder 14. Thus, the image recorder 25 and the developing device 26 employed in the prepress step for the plates P and the first and second blanket cylinders 13 and 14 and the ink feeder 20 or the damping water feeders 21 and 22 employed in the printing step can be arranged on different positions, not to interfere with each other. Thus, the space for arranging these elements is easy to ensure, and the degree of freedom in the arrangement relation can be improved. Further, the printing apparatus can record images on the plates P held on the first and second plate cylinders 11 and 12 with a single image recorder 25, whereby the apparatus can be simplified in structure and the cost therefor can be reduced.

The operation of the printing apparatus in the aforementioned printing step is now described. First, description is made with reference to the case of printing only a single surface of the printing-paper S with the printing apparatus.

FIGS. 18A to 20B are explanatory diagrams showing the single-sided printing operation for printing the single surface of the printing-paper S with yellow, magenta, cyan and black inks.

Referring to FIGS. 18A to 20B, symbol K denotes regions of the first plate cylinder 11 and the first blanket cylinder 13 employed for printing with the black ink, symbol M denotes regions of the first plate cylinder 11 and the first blanket cylinder 13 employed for printing with the magenta ink, symbol C denotes regions of the second plate cylinder 12 and the second blanket cylinder 14 employed for printing with the cyan ink, and symbol Y denotes regions of the second plate cylinder 12 and the second blanket cylinder 14 employed for printing with the yellow ink respectively, for simplifying the illustration.

It is assumed that the image areas 67*a* and 67*b* for printing with the black and magenta inks respectively are recorded on the plate P mounted on the outer peripheral portion of the first plate cylinder 11 as shown in FIG. 5A and the image areas 67*c* and 67*d* for printing with the cyan and yellow inks respectively are recorded on the plate P mounted on the outer peripheral portion of the second plate cylinder 12 as shown in FIG. 5B, in the prepress step preceding the printing step. The ink feeders 20*a*, 20*b*, 20*c* and 20*d* are supplied with the black, magenta, cyan and yellow inks respectively.

The bearing 74 shown in FIG. 8 is arranged on the third position in each of the ink feeders 20*a* and 20*c*, and on the second position in each of the ink feeders 20*b* and 20*d*, so that the image areas 67*a*, 67*b*, 67*c* and 67*d* of the plates P shown in FIG. 5A and 5B are supplied with the black, magenta, cyan and yellow inks from the ink feeders 20*a*, 20*b*, 20*c* and 20*d* respectively.

First, the printing apparatus brings the first and second blanket cylinders 13 and 14 into separated states arranged on positions separated from the impression cylinder 15, due to the action of the contact mechanism shown in FIG. 10. In this state, the printing apparatus rotates the first and second plate cylinders 11 and 12 and the first and second blanket cylinders 13 and 14. At this time, the impression cylinder 15, the feed cylinder 16, the removal cylinder 17 and the reverse cylinder 18 are also rotated in synchronization.

In this state, the damping water feeders 21 and 22 are brought into contact with the plates P held on the first and second plate cylinders 11 and 12 respectively. Further, each ink feeder 20 is brought into contact with only the corresponding image area of the plate P held on the first or second plate cylinder 11 or 12. Thus, the image areas 67*a*, 67*b*, 67*c* and 67*d* are supplied with the damping water, and further supplied with the black, magenta, cyan and yellow inks from the ink feeders 20*a*, 20*b*, 20*c* and 20*d* respectively. These inks are transferred to the corresponding regions of the first and second blanket cylinders 13 and 14 respectively.

The printing apparatus repeats this operation, thereby feeding the inks to the plates P mounted on the first and second plate cylinders 11 and 12 and the first and second blanket cylinders 13 and 14. The printing apparatus repetitively executes this ink feed operation until the printing step is completed.

When the plates P mounted on the first and second plate cylinders 11 and 12 and the first and second blanket cylinders 13 and 14 are completely supplied with the inks, the printing-paper S is fed to the feed cylinder 16, so that the gripper 84 of the feed cylinder 16 holds its forward end portion. The gripper 84 of the feed cylinder 16 transfers the printing-paper S to the gripper 83 of the impression cylinder 15.

Figure 18A:
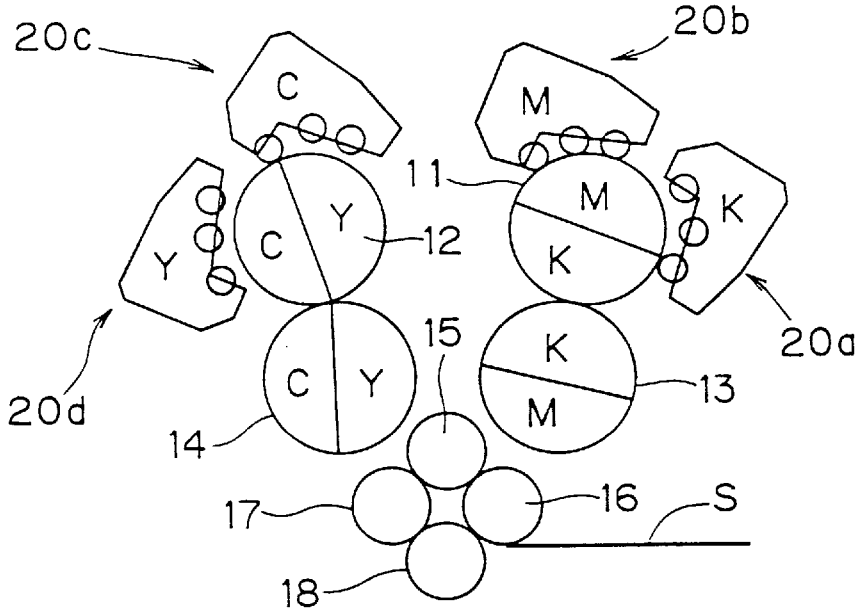
FIGS. 18A and 18B are explanatory diagrams showing a printing operation of the printing apparatus in case of performing single-sided four-color printing.
Figure 18B:
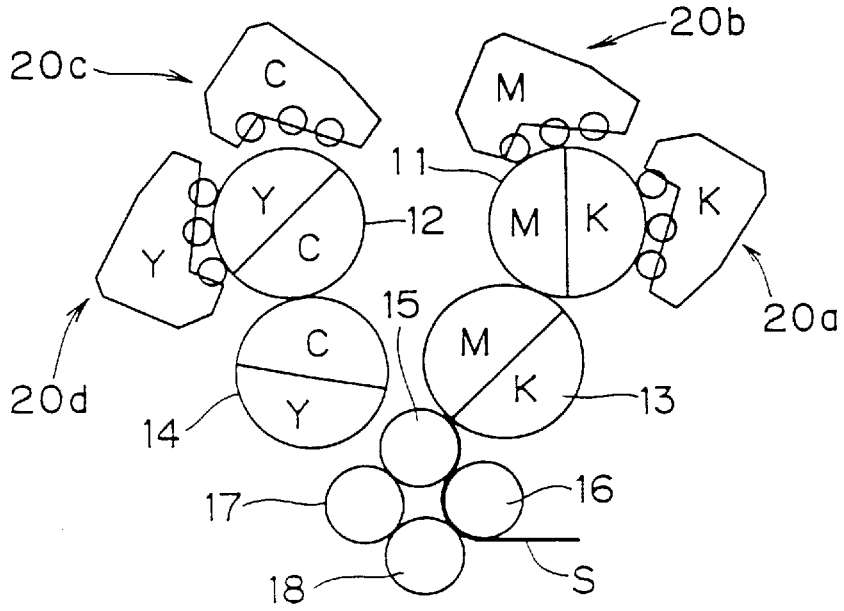

When the impression cylinder 15 further rotates to move the forward end of the printing-paper S held on the outer periphery of the impression cylinder 15 to the position opposed to the first blanket cylinder 13, the contact mechanism shown in FIG. 10 brings the first blanket cylinder 13 into contact with the impression cylinder 15. In this state, the forward end portion of the printing-paper S comes into contact with an end portion of the region of the first blanket cylinder 13 employed for printing with the black ink, as shown in FIG. 18B. The black ink is transferred from the image area 67*a* of the plate P held on the first plate cylinder 11 to the region of the first blanket cylinder 13 employed for the printing with the black ink. Therefore, the black ink is transferred to the printing-paper S due to further rotation of the first blanket cylinder 13 and the impression cylinder 15.

Figure 19A:
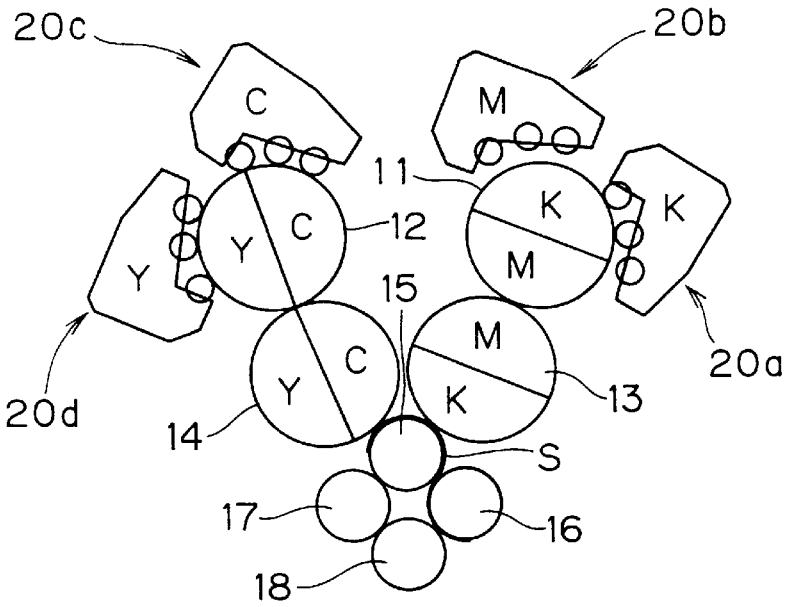
FIGS. 19A and 19B are explanatory diagrams showing the printing operation of the printing apparatus in case of performing single-sided four-color printing.

When the impression cylinder 15 further rotates to move the forward end of the printing-paper S held on the outer periphery of the impression cylinder 15 to the position opposed to the second blanket cylinder 14, the contact mechanism shown in FIG. 10 brings the second blanket cylinder 14 into contact with the impression cylinder 15. In this state, the forward end portion of the printing-paper S comes into contact with an end portion of the region of the second blanket cylinder 14 employed for printing with the cyan ink, as shown in FIG. 19A. The cyan ink is transferred from the image area 67*c* of the plate P held on the second plate cylinder 12 to the region of the second blanket cylinder 14 employed for the printing with the cyan ink. Therefore, the cyan ink is transferred to the printing-paper S, to which the black ink is already transferred, due to further rotation of the second blanket cylinder 14 and the impression cylinder 15.

Figure 19B:
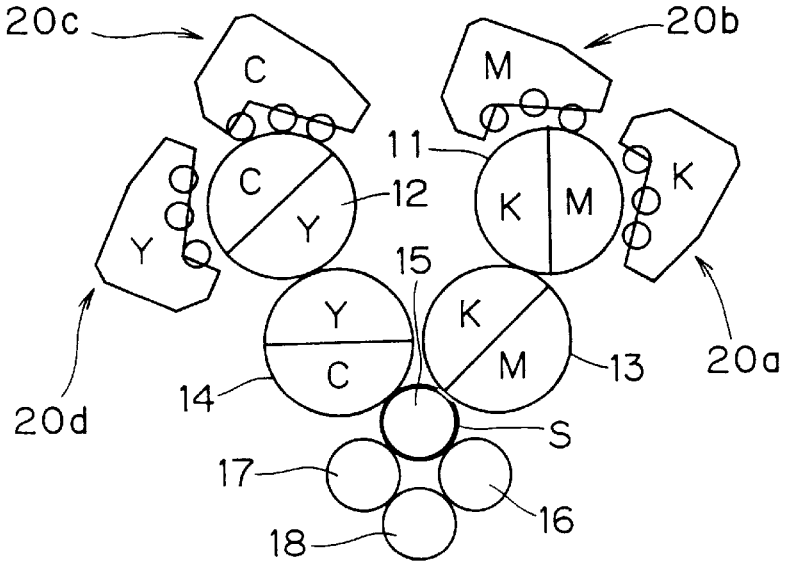

The impression cylinder 15 continuously rotates with the first and second blanket cylinders 13 and 14 in this state, whereby the printing-paper S is completely wound on the outer peripheral portion of the impression cylinder 15, as shown in FIG. 19B. The impression cylinder 15 has the diameter half that of the first and second plate cylinders 11 and 12 and the first and second blanket cylinders 13 and 14, whereby the printing-paper S which is wound on the outer peripheral portion of the impression cylinder 15 comes into contact with the region of the first blanket cylinder 13 employed for printing with the magenta ink in second rotation. The magenta ink is transferred from the image area 67*b* of the plate P held on the first plate cylinder 11 to the region of the first blanket cylinder 13 employed for printing with the magenta ink. Thus, the magenta ink is further transferred to the printing-paper S, to which the black and cyan inks are already transferred, due to further rotation of the first blanket cylinder 13 and the impression cylinder 15.

When the impression cylinder 15 further rotates, the printing-paper S comes into contact with an end portion of the region of the second blanket cylinder 14 employed for printing with the yellow ink. The yellow ink is transferred from the image area 67*d* of the plate P held on the second plate cylinder 12 to the region of the second blanket cylinder 14 employed for printing with the yellow ink. Due to further rotation of the second blanket cylinder 14 and the impression cylinder 15, therefore, the yellow ink is further transferred to the printing-paper S, to which the black, cyan and magenta inks are already transferred, for completing the four-color printing.

Figure 20A:
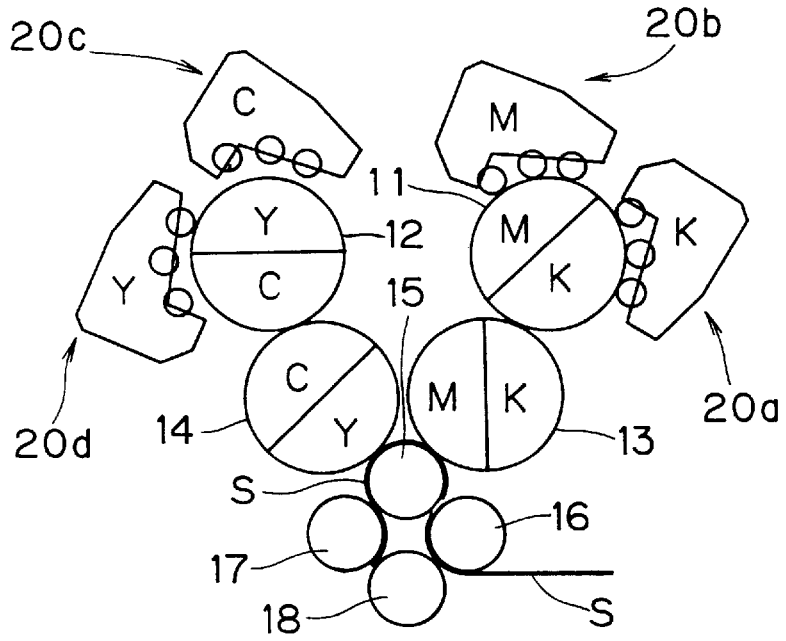
FIGS. 20A and 20B are explanatory diagrams showing the printing operation of the printing apparatus in case of performing single-sided four-color printing.

The gripper 83 of the impression cylinder 15 transfers the forward end portion of the printing-paper S completely printed in four colors to the gripper 85 of the removal cylinder 17, as shown in FIG. 20A. The printing-paper S to be subsequently printed is fed to the feed cylinder 16, and thereafter transferred from the gripper 84 of the feed cylinder 16 to the gripper 83 of the impression cylinder 15.

Figure 20B:
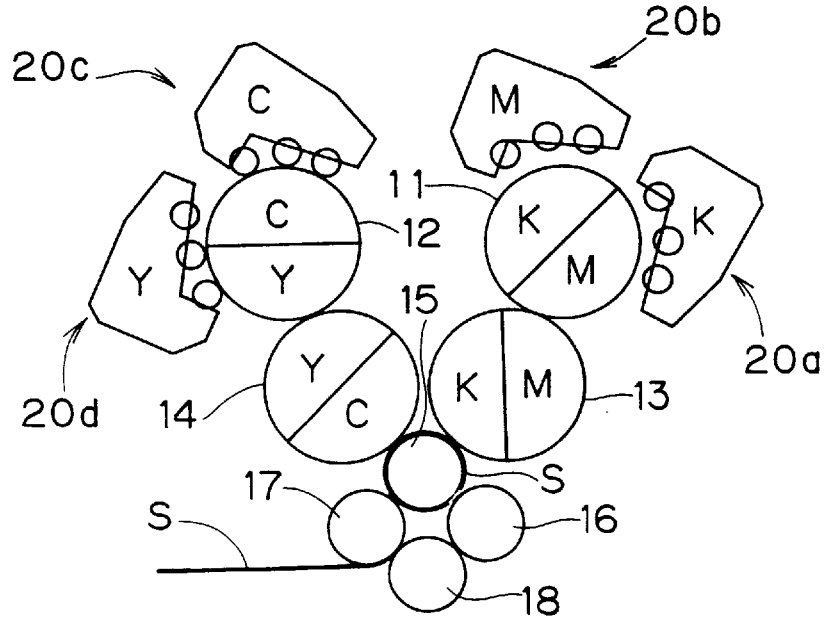

The printing-paper S completely printed in four colors is driven by the pair of chains 19 to be transported onto the removal part 28 with the gripper 85 of the removal cylinder 17, as shown in FIG. 20B.

As hereinabove described, the diameter of the impression cylinder 15 is half that of the first and second plate cylinders 11 and 12 and the first and second blanket cylinders 13 and 14, whereby the impression cylinder 15 rotates twice while the first and second plate cylinders 11 and 12 and the first and second blanket cylinders 13 and 14 rotate once. The printing-paper S held on the outer peripheral portion of the impression cylinder 15 is printed in four colors of yellow, magenta, cyan and black while the impression cylinder 15 rotates twice. Thus, the printing apparatus can continuously execute four-color printing by feeding a new printing-paper S from the feed cylinder 16 every time the impression cylinder 15 rotates twice.

In case of performing the aforementioned single-sided printing in this printing apparatus, it is also possible to print a single surface of each printing-paper S not with four-color inks but with one to three-color inks.

In case of printing a single surface of each printing-paper S with only the black ink, for example, the printing apparatus forms identical images on the image areas 67*a* and 67*b* of the plate P held on the first plate cylinder 11. In the ink feeder 20*a,* the bearing 74 shown in FIG. 8 is arranged on the first position. The remaining ink feeders 20*b,* 20*c* and 20*d* are separated from the first and second plate cylinders 11 and 12.

In this state, the printing apparatus feeds a new printing-paper S from the feed cylinder 16 every time the impression cylinder 15 rotates once. Thus, the printing apparatus can perform single-sided monochrome printing by transferring the image to the printing-paper S held on the outer periphery of the impression cylinder 15 from the image area 67*a* or 67*b* provided with the same image every time the impression cylinder 15 rotates once.

In this case, the second plate cylinder 12 and the second blanket cylinder 14 are not used. Therefore, the second blanket cylinder 14 may be received in the contact mechanism shown in FIG. 10. The printing apparatus may move the second plate cylinder 12 to the image recording position while performing printing with the first plate cylinder 11 and the first blanket cylinder 13, for executing the prepress step on the second plate cylinder 12 on this position.

In case of printing a single surface of each printing-paper S with the cyan and magenta inks, the printing apparatus forms identical images to be printed with the magenta ink on the image areas 67*a* and 67*b* of the plate P held on the first plate cylinder 11. The printing apparatus also forms identical images to be printed with the cyan ink on the image areas 67*c* and 67*d* of the plate P held on the second plate cylinder 12. Further, the printing apparatus arranges the bearing 74 shown in FIG. 8 on the first position in each of the ink feeders 20*b* and 20*c*. Further, the printing apparatus separates the ink feeders 20*a* and 20*d* from the first and second plate cylinders 11 and 12.

In this state, the printing apparatus feeds a new printing-paper S from the feed cylinder 16 every time the impression cylinder 15 rotates once. Thus, the printing apparatus can perform single-sided two-color printing by successively transferring the images in the magenta and cyan inks to the printing-paper S held on the outer periphery of the impression cylinder 15 from the image area 67*a* or 67*b* and the image area 67*c* or 67*d* provided with the same images respectively every time the impression cylinder 15 rotates once.

In case of performing single-sided two-color printing with the black and magenta inks, the printing apparatus must feed a new printing-paper S every time the impression cylinder 15 rotates twice. In this case, the printing apparatus forms images to be printed with the black and magenta inks on the image areas 67*a* and 67*b* of the plate P held on the first plate cylinder 11 respectively. The printing apparatus arranges the bearing 74 shown in FIG. 8 on the third position in the ink feeder 20*a* and on the second position in the ink feeder 20*b*.

Further, the printing apparatus separates the ink feeders 20*c* and 20*d* from the second plate cylinder 12.

In this state, the printing apparatus feeds a new printing-paper S from the feed cylinder 16 every time the impression cylinder 15 rotates twice. Thus, the printing apparatus can perform single-sided two-color printing by transferring the images to the printing-paper S held on the outer periphery of the impression cylinder 15 from the image areas 67*a* and 67*b* with the black and magenta inks every time the impression cylinder 15 rotates once.

Also in this case, the second plate cylinder 12 and the second blanket cylinder 14 are not used. Therefore, the contact mechanism shown in FIG. 10 may receive the second blanket cylinder 14. Alternatively, the printing apparatus may move the second plate cylinder 12 to the image recording position while performing printing with the first plate cylinder 11 and the first blanket cylinder 13, for executing the prepress step on the second plate cylinder 12 on this position.

In case of printing a single surface of each printing-paper S with three color inks of yellow, magenta and cyan, the printing apparatus forms an image to be printed with the magenta ink on the image area 67*b* of the plate P held on the first plate cylinder 11 while forming images to be printed with the cyan and yellow inks on the image areas 67*c* and 67*d* of the plate P held on the second plate cylinder 12 respectively. The printing apparatus arranges the bearing 74 shown in FIG. 8 on the third position in the ink feeder 20*c* and on the second position in each of the ink feeders 20*b* and 20*d*. The printing apparatus separates the ink feeder 20*a* from the first plate cylinder 11.

In this state, the printing apparatus feeds a new printing-paper S from the feed cylinder 16 every time the impression cylinder 15 rotates twice. Thus, the printing apparatus can perform single-sided three-color printing by transferring the images on the printing-paper S held on the outer periphery of the impression cylinder 15 with the magenta, cyan and yellow inks from the image areas 67*b*, 67*c* and 67*d* every time the impression cylinder 15 rotates twice.

Description is now made on the case of printing both surfaces of the printing-paper S with the printing apparatus.

FIGS. 21A to 25B are explanatory diagrams showing a double-sided two-color printing operation for printing front and rear surfaces of the printing-paper S with two color inks of cyan and magenta in this printing apparatus.

Referring to FIGS. 21A to 25B, symbol M1 denotes regions (hereinafter referred to as regions M1) of the first plate cylinder 11 and the first blanket cylinder 13 employed for printing the front surface of the printing-paper S with the magenta ink, and symbol M2 denotes regions (hereinafter referred to as regions M2) of the first plate cylinder 11 and the first blanket cylinder 13 employed for printing the rear surface of the printing-paper S with the magenta ink, for convenience of illustration. Further, symbol C1 denotes regions (hereinafter referred to as regions C1) of the second plate cylinder 12 and the second blanket cylinder 14 employed for printing the front surface of the printing-paper S with the cyan ink, and symbol C2 denotes regions (hereinafter referred to as regions C2) of the second plate cylinder 12 and the second blanket cylinder 14 employed for printing the rear surface of the printing-paper S with the cyan ink.

It is assumed that the image areas 67*a* and 67*b* for printing the front and rear surfaces of the printing-paper S with the magenta ink respectively are recorded on the plate P which is mounted on the outer peripheral portion of the first plate cylinder 11 as shown in FIG. 5A, while the image areas 67*c* and 67*d* for printing the front and rear surfaces of the printing-paper S with the cyan ink respectively are recorded on the plate P which is mounted on the outer peripheral portion of the second plate cylinder 12 as shown in FIG. 5B in the prepress step preceding the printing step. Similarly to the aforementioned case of single-sided four-color printing, the ink feeders 20*b* and 20*c* are supplied with the magenta and cyan inks respectively.

The printing apparatus arranges the bearing 74 shown in FIG. 8 on the first position in each of the ink feeders 20*b* and 20*c*. The printing apparatus separates the ink feeders 20*a* and 20*d* from the first and second plate cylinders 11 and 12 by swinging the side plates 72 about the shafts 71 by the driving source (not shown). Thus, the ink feeder 20*b* supplies the image areas 67*a* and 67*b* with the magenta ink, and the ink feeder 20*c* supplies the image areas 67*c* and 67*d* with the cyan ink respectively.

First, the contact mechanism shown in FIG. 10 arranges the first and second blanket cylinders 13 and 14 on positions separated from the impression cylinder 15. In this state, the printing apparatus rotates the first and second plate cylinders 11 and 12 and the first and second blanket cylinders 13 and 14. At this time, the impression cylinder 15, the feed cylinder 16, the removal cylinder 17 and the reverse cylinder 18 are also rotated in synchronization.

In this state, the printing apparatus brings the damping water feeders 21 and 22 into contact with the plates P held on the first and second plate cylinders 11 and 12 respectively. The printing apparatus further brings the ink feeders 20*b* and 20*c* into contact with the plates P held on the first and second plate cylinders 11 and 12 respectively. Thus, the image areas 67*a*, 67*b*, 67*c* and 67*d* are supplied with the damping water, while the image areas 67*a* and 67*b* are supplied with the magenta ink from the ink feeder 20*b* and the image areas 67*c* and 67*d* are supplied with the cyan ink from the ink feeder 20*c*. These inks are transferred to the corresponding regions of the first and second blanket cylinders 13 and 14 respectively.

The printing apparatus repeats this operation, thereby feeding the inks to the plates P held on the first and second plate cylinders 11 and 12 and the first and second blanket cylinders 13 and 14. The printing apparatus repetitively performs this ink feed operation until completing the printing step.

Figure 21A:
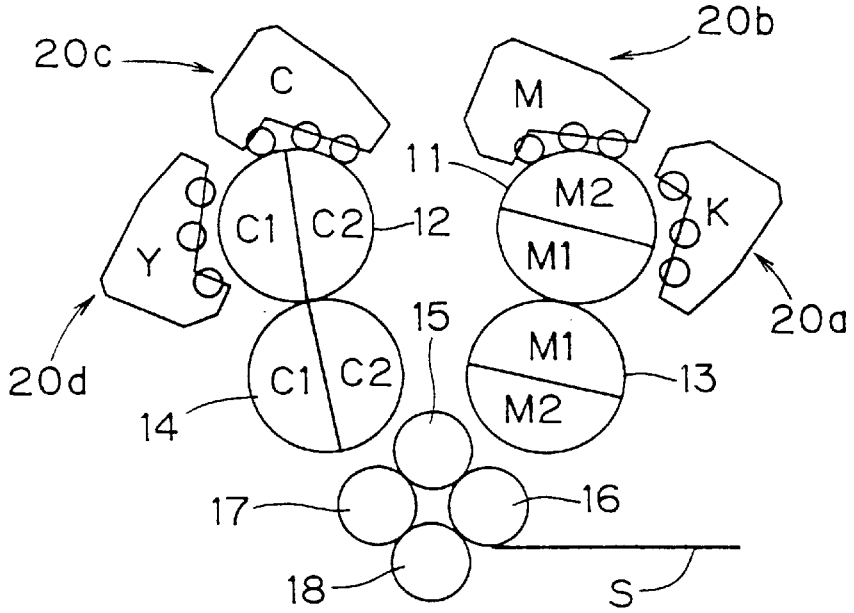
FIGS. 21A and 21B are explanatory diagrams showing a printing operation of the printing apparatus in case of performing double-sided two-color printing.

When the plates P held on the first and second plate cylinders 11 and 12 and the first and second blanket cylinders 13 and 14 are completely supplied with the inks, the printing apparatus feeds the printing-paper S to the feed cylinder 16, so that the gripper 84 of the feed cylinder 16 holds the forward end portion of the printing-paper S, as shown in FIG. 21A. The gripper 84 of the feed cylinder 16 transfers the printing-paper S to the gripper 83 of the impression cylinder 15.

Figure 21B:
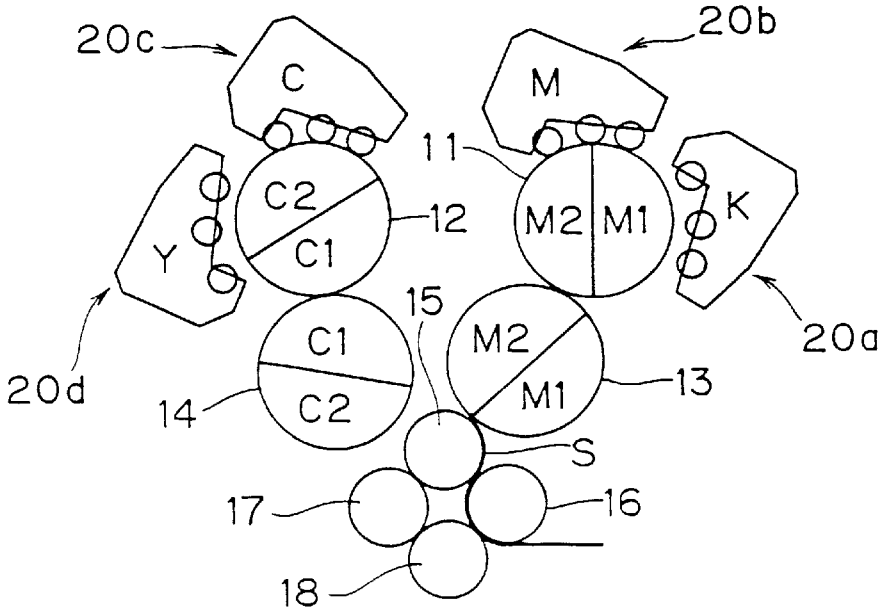

The impression cylinder 15 further rotates so that the forward end of the printing-paper S held on the outer periphery of the impression cylinder 15 moves to the position opposed to the first blanket cylinder 13, and the contact mechanism shown in FIG. 10 brings the first blanket cylinder 13 into contact with the impression cylinder 15. In this state, the forward end portion on the front surface of the printing-paper S comes into contact with an end portion of the region M1 of the first blanket cylinder 13, as shown in FIG. 21B. The magenta ink is transferred to the region M1 from the image area 67*a* of the plate P held on the first plate cylinder 11. Due to further rotation of the first blanket cylinder 13 and the impression cylinder 15, therefore, the magenta ink is transferred to the front surface of the printing-paper S.

The impression cylinder 15 further rotates so that the forward end of the printing-paper S held on the outer periphery of the impression cylinder 15 moves to the position opposed to the second blanket cylinder 14, and the contact mechanism shown in FIG. 10 brings the second blanket cylinder 14 into contact with the impression cylinder 15. In this state, the forward end portion of the printing-paper S comes into contact with an end portion of the region C1 of the second blanket cylinder 14. The cyan ink is transferred to the region C1 from the image area 67*c* of the plate P held on the second plate cylinder 12. Due to further rotation of the second blanket cylinder 14 and the impression cylinder 15, therefore, the cyan ink is further transferred to the front surface of the printing-paper S, on which the magenta ink has already been transferred In parallel with this, the printing apparatus feeds a second printing-paper S to the feed cylinder 16, so that the gripper 84 of the feed cylinder 16 holds the forward end portion of this printing-paper S. The gripper 84 of the feed cylinder 16 transfers the second printing-paper S to the gripper 83 of the impression cylinder 15, similarly to the first printing-paper S.

Figure 22A:
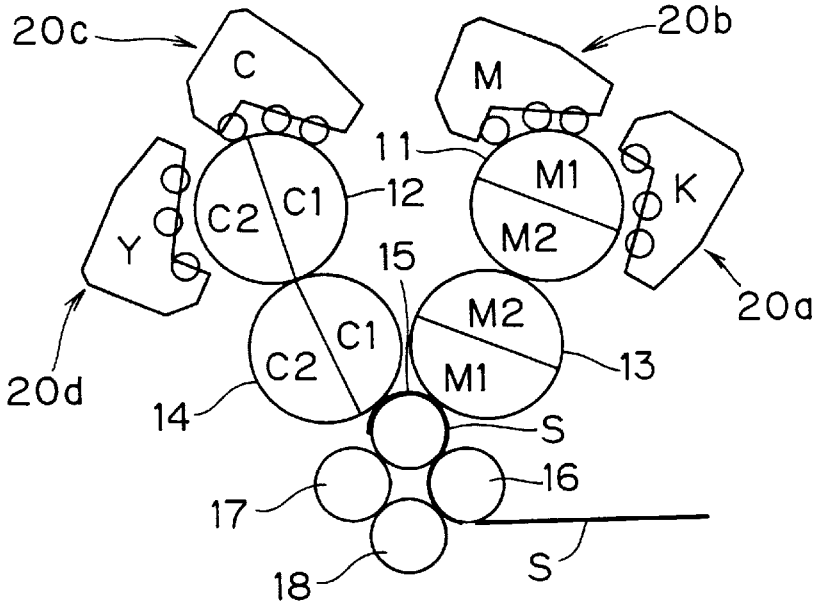
FIGS. 22A and 22B are explanatory diagrams showing the printing operation of the printing apparatus in case of performing double-sided two-color printing.
Figure 22B:
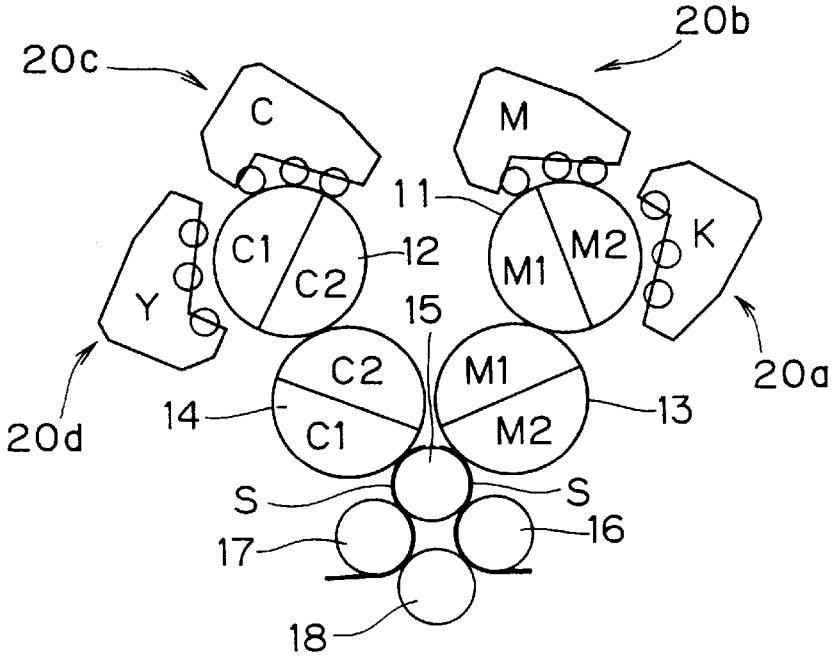

In this state, the impression cylinder 15 continuously rotates with the first and second blanket cylinders 13 and 14, whereby the gripper 83 of the impression cylinder 15 transfers the first printing-paper S to the gripper 85 of the removal cylinder 17, so that the first printing-paper S is transported along the pair of chains 9, as shown in FIG. 22B. In parallel with this, the front surface of the second printing-paper S comes into contact with the region M2. The region M2 is originally adapted to print the rear surface, and hence the image on the image area 67*b* to be printed on the rear surface is printed on the front surface. Therefore, the second printing-paper S is discarded later.

Figure 23A:
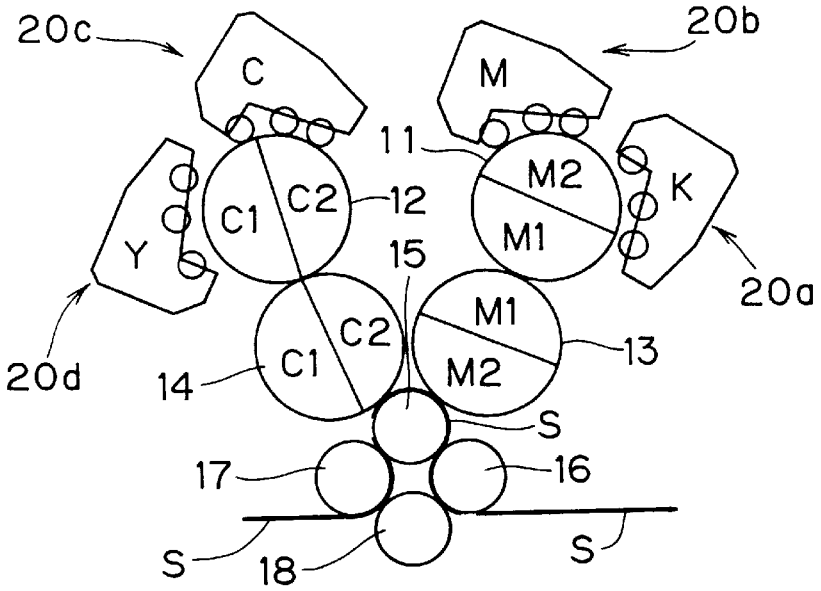
FIGS. 23A and 23B are explanatory diagrams showing the printing operation of the printing apparatus in case of performing double-sided two-color printing.

The impression cylinder 15 further rotates with the first and second blanket cylinders 13 and 14, whereby the front surface of the second printing-paper S comes into contact with the region C2, as shown in FIG. 23A. In parallel with this, the printing apparatus feeds a third printing-paper S to the feed cylinder 16, so that the gripper 84 of the feed cylinder 16 holds the forward end portion of this printing-paper S.

Figure 23B:
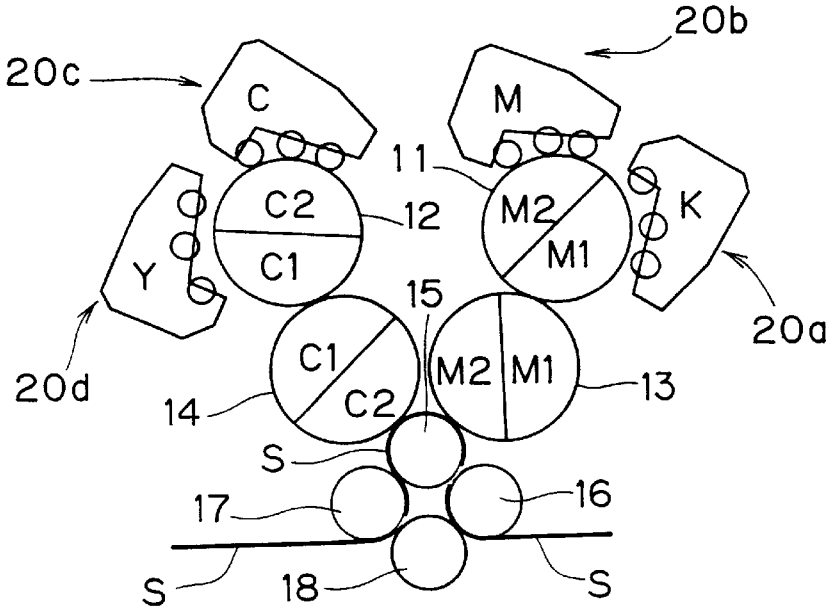

Due to further rotation of the impression cylinder 15, the gripper 86 of the reverse cylinder 18 holds the rear end of the first printing-paper S transported along the pair of chains 19, as shown in FIG. 23B. Due to the operation shown in FIGS. 13A to 14B, the gripper 86 transfers the rear end of the first printing-paper S to the gripper 87. In parallel with this, the gripper 84 of the feed cylinder 16 transfers the third printing-paper S to the gripper 83 of the impression cylinder 15.

Figure 24A:
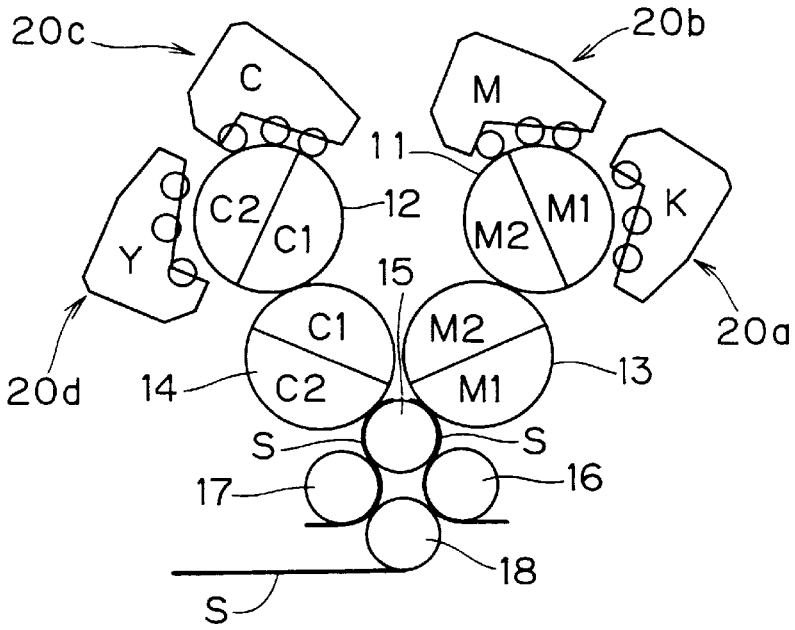
FIGS. 24A and 24B are explanatory diagrams showing the printing operation of the printing apparatus in case of performing double-sided two-color printing.

Due to further rotation of the impression cylinder 15, the gripper 87 of the reverse cylinder 18 transports the first printing-paper S toward the feed cylinder 16, as shown in FIG. 24A. In parallel with this, the gripper 85 of the removal cylinder 17 holds the second printing,-paper S, for transporting the same along the pair of chains 19. Further, the forward end portion of the front surface of the third printing-paper S comes into contact with an end portion of the region M1 of the first blanket cylinder 13. The first blanket cylinder 13 and the impression cylinder 15 further rotate, for transferring the magenta ink to the front surface of the third printing-paper S.

The impression cylinder 15 further rotates, so that the gripper 84 of the feed cylinder 16 holds the forward end of the first printing-paper S and transports the same. The gripper 84 of the feed cylinder 16 transfers the forward end of the first printing-paper S to the gripper 83 of the impression cylinder 15. Thus, the first printing-paper S completely printed on its front surface is reversed and fed to the impression cylinder 15 again from its rear end. At this time, the printing-paper S is transferred to a position on the impression cylinder which lags by the same distance as the outer periphery of the first plate cylinder (or the second plate cylinder). After the front surface is printed, the printing-paper returns to the impression cylinder 15 which has rotated twice, and the rear surface is printed when the impression cylinder 15 rotates for the third time counting from the time the front surface was printed. This is possible by transferring the rear end of the printing-paper S along an extra path on the removal cylinder 17, the reverse cylinder 18 and the feed cylinder 16 at the speed of the outer periphery of the impression cylinder, wherein the extra path has the length of the paper subtracted from the length of the outer periphery of the first plate cylinder (or the second plate cylinder). Furthermore, in this printing apparatus, the reversed printing-paper S can easily return to its appropriate position by setting the transfer path of the printing-paper S integral times the length of the printing-paper S. Thus, the printing-paper S comes out of phase, so that its rear surface comes into contact with the region M2 of the first blanket cylinder 13. Therefore, the rear surface of the printing-paper S, whose front surface has come into contact with the region M1 in advance, can be prevented from coming into contact with the region M1 again.

Figure 24B:
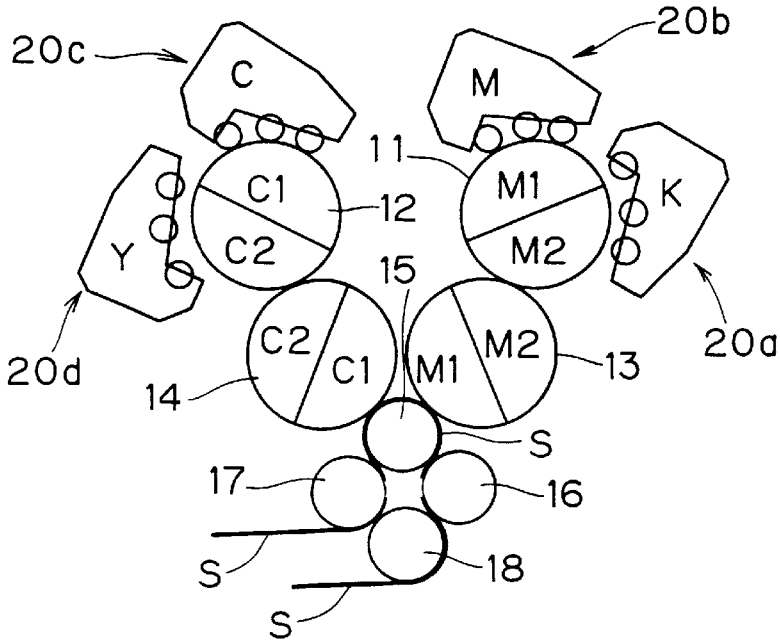

In the state shown in FIG. 24B, the gripper 85 of the removal cylinder 17 holds the forward end of the second printing-paper S and transports the same along the pair of chains 19. Further, the third printing-paper S comes into contact with the region C1 of the second blanket cylinder 14. Thus, the cyan ink is transferred to the front surface of the third printing-paper S, to which the magenta ink has already been transferred.

The impression cylinder 15 further rotates, so that the forward end portion of the rear surface of the first printing-paper S comes into contact with an end portion of the region M2 of the first blanket cylinder 13. The magenta ink has already been transferred to the region M2 from the image area 67*b* of the plate P held on the first plate cylinder 11. Due to further rotation of the first blanket cylinder 13 and the impression cylinder 15, therefore, the magenta ink is transferred to the rear surface of the printing-paper S. The second printing-paper S whose front surface is printed with the images of the image areas 67*b* and 67*d* to be originally printed on the rear surface is removed to the removal part 28 and discarded with no printing on its rear surface.

Figure 25A:
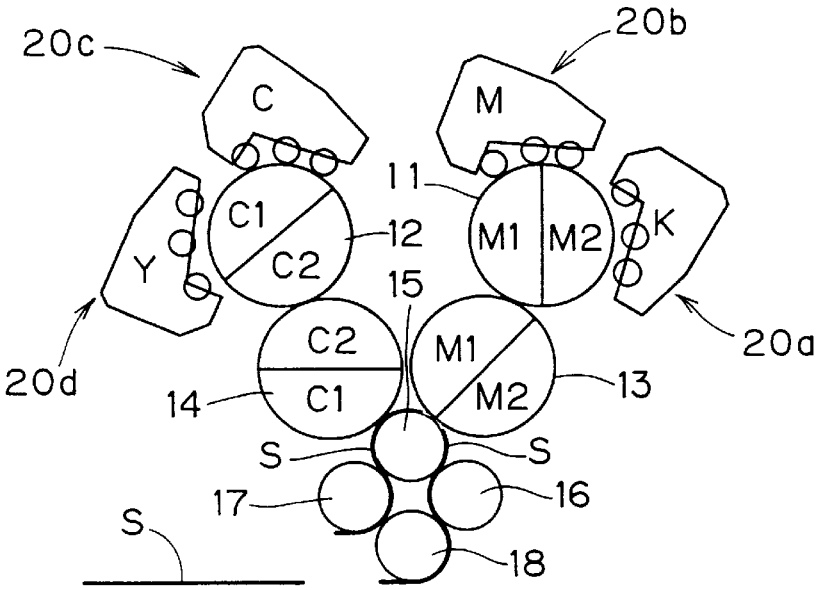
FIGS. 25A and 25B are explanatory diagrams showing the printing operation of the printing apparatus in case of performing double-sided two-color printing.
Figure 25B:
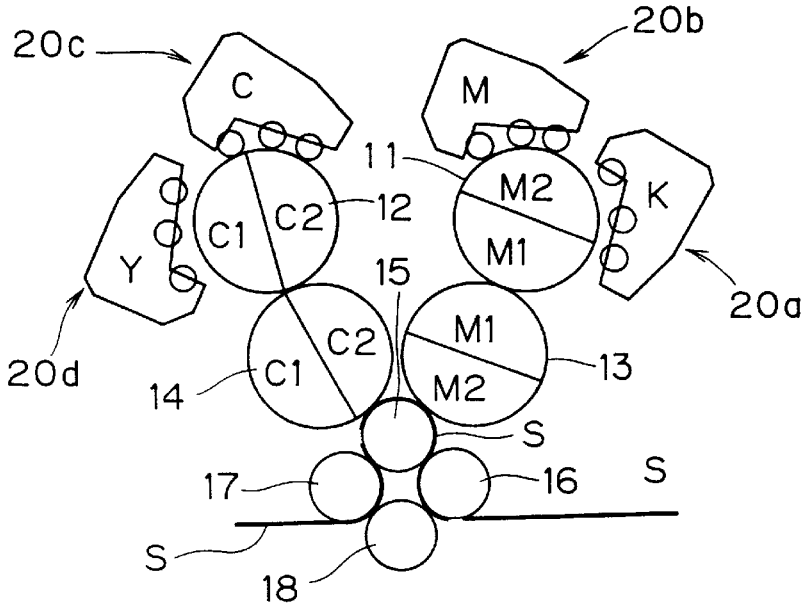

The impression cylinder 15 further rotates, so that the front end portion of the rear surface of the first printing-paper S comes into contact with an end portion of the region C2 of the second blanket cylinder 14, as shown in FIG. 25B. The cyan ink has already been transferred to the region C2 from the image area 67*d* of the plate P held on the second plate cylinder 12. Due to further rotation of the second blanket cylinder 14 and the impression cylinder 15, therefore, the cyan ink is transferred to the rear surface of the printing-paper S, to which the magenta ink has already been transferred. Thus, the front and rear surfaces of the first printing-paper S are printed with the magenta and cyan inks. The gripper 85 of the removal cylinder 17 holds the forward end of the first printing-paper S completely subjected to double-sided two-color printing, for transporting the same along the pair of chains 19 and removing the same to the removal part 28.

In the state shown in FIG. 25B, the gripper 85 of the removal cylinder 17 holds the forward end of the third printing-paper S having the front surface to which the magenta and cyan inks are transferred, and transports the same along the pair of chains 19. The magenta and cyan inks are transferred also to the rear surface of the third printing-paper S through a step similar to that for the first printing-paper S, for performing double-sided two-color printing.

In the state shown in FIG. 25B, further, the printing apparatus feeds a fourth printing-paper S to the feed cylinder 16. The fourth printing-paper S is also subjected to double-sided two-color printing through a step similar to those for the first and third printing-papers S.

As hereinabove described, the diameter of the impression cylinder 15 is half that of the first and second plate cylinders 11 and 12 and the first and second blanket cylinders 13 and 14 in this printing apparatus, whereby the impression cylinder 15 rotates twice every time the first and second plate cylinders 11 and 12 and the first and second blanket cylinders 13 and 14 rotate once. The printing apparatus performs two-color printing on the two printing-papers S which are held on the outer peripheral portion of the impression cylinder 15 to alternately direct its front and rear surfaces outward while the impression cylinder 15 rotates twice. Therefore, the printing apparatus can continuously execute double-sided two-color printing by feeding a new printing-paper S from the feed cylinder 16 every time the impression cylinder 15 rotates twice.

In particular, the two colors for each surface are not fixed but a color can be selected from black and magenta and that can be selected from cyan and yellow if each ink feeder 20 can feed the ink to an arbitrary one of the image areas 67*a*, 67*b*, 67*c* and 67*d* of the plates P held on the first and second plate cylinders 11 and 12 similarly to the aforementioned embodiment, for example.

The printing apparatus can perform not only double-sided two-color printing for printing both surfaces of each printing-paper S with two inks but also double-sided monochrome printing for printing both surfaces of each printing-paper P with a single ink and double-sided two-color single-sided monochrome printing for printing a single surface of each printing-paper S with two color inks while printing the other surface with a single ink.

In this case, the printing apparatus forms only necessary ones among the image areas 67*a*, 67*b*, 67*c* and 67*d*. Further, each ink feeder 20 supplies the ink to the corresponding one of the formed image areas 67*a*, 67*b*, 67*c* and 67*d*. The printing apparatus can perform double-sided monochrome printing or single-sided two-color single-sided monochrome printing by executing an operation similar to that for the aforementioned double-sided two-color printing.

In case of printing the front and rear surfaces of the printing-paper S with magenta and cyan inks respectively, for example, images to be printed with the magenta and cyan inks on the image areas 67*a* and 67*d* respectively. The printing apparatus arranges the bearing 74 shown in FIG. 8 on the third position in the ink feeder 20*b* and on the second position in the ink feeder 20*c*. Further, the printing apparatus separates the ink feeders 20*a* and 20*d* from the first and second plate cylinders 11 and 12. The printing apparatus can continuously execute printing for transferring the magenta and cyan images on the front and rear surfaces of the printing-paper S by feeding a new printing-paper S every time the impression cylinder 15 rotates twice.

In case of printing both surfaces of the printing-paper S with the black ink, the printing apparatus forms images to be printed on the front and rear surfaces of the printing-paper S on the image areas 67*a* and 67*b* of the plate P held on the first plate cylinder 11 respectively. The printing apparatus arranges the bearing 74 shown in FIG. 8 on the first position in the ink feeder 20*a*. On the other hand, the printing apparatus separates the ink feeders 20*b*, 20*c* and 20*d* from the first and second plate cylinders 11 and 12. The printing apparatus can continuously execute printing for transferring black images on both surfaces of the printing-paper by feeding a new printing-paper S every time the impression cylinder 15 rotates twice.

In case of employing only one of the first and second blanket cylinders 13 and 14 for printing both surfaces of the printing-paper S with a single ink or the like, the contact mechanism shown in FIG. 10 may receive the remaining blanket cylinder. Alternatively, the printing apparatus may move the remaining plate cylinder while performing printing with one of the plate cylinders and one of the blanket cylinders, for executing the prepress step on the plate cylinder on this position.

While the aforementioned printing apparatus forms the image areas 67*a*, 67*b*, 67*c* and 67*d* on the plates P held on the first and second plate cylinders 11 and 12 respectively and employs the impression cylinder 15 having the diameter half that of the first and second plate cylinders 11 and 12 and the first and second blanket cylinders 13 and 14, the present invention is not restricted to such a mode.

It is assumed with reference to natural numbers N and M that the diameter of the impression cylinder is [(2M−1)/2N] times that of the first and second plate cylinders and the first and second blanket cylinders if [2N] image areas are formed on the first and second plate cylinders. Thus, the impression cylinder rotates [2N] times while the first and second plate cylinders and the first and second blanket cylinders rotate [2M−1] times. The numbers [2N] and [2M−1] are even and odd numbers respectively, whereby [2N] images formed on the first and second plate cylinders respectively are transferred once to each of [2M−1] printing-papers S held on the outer periphery of the impression cylinder while the impression cylinder rotates [2N] times. Therefore, arranging [2N] ink feeders around the first plate cylinder and [2N] ink feeders around the second plate cylinder, the printing apparatus can print a single surface of each printing-paper S in [4N] colors or both surfaces of each printing-paper S in [2N] colors. The ink feeders provided respectively around the first and second plate cylinders may be less than [2N], of course.

Figure 26:
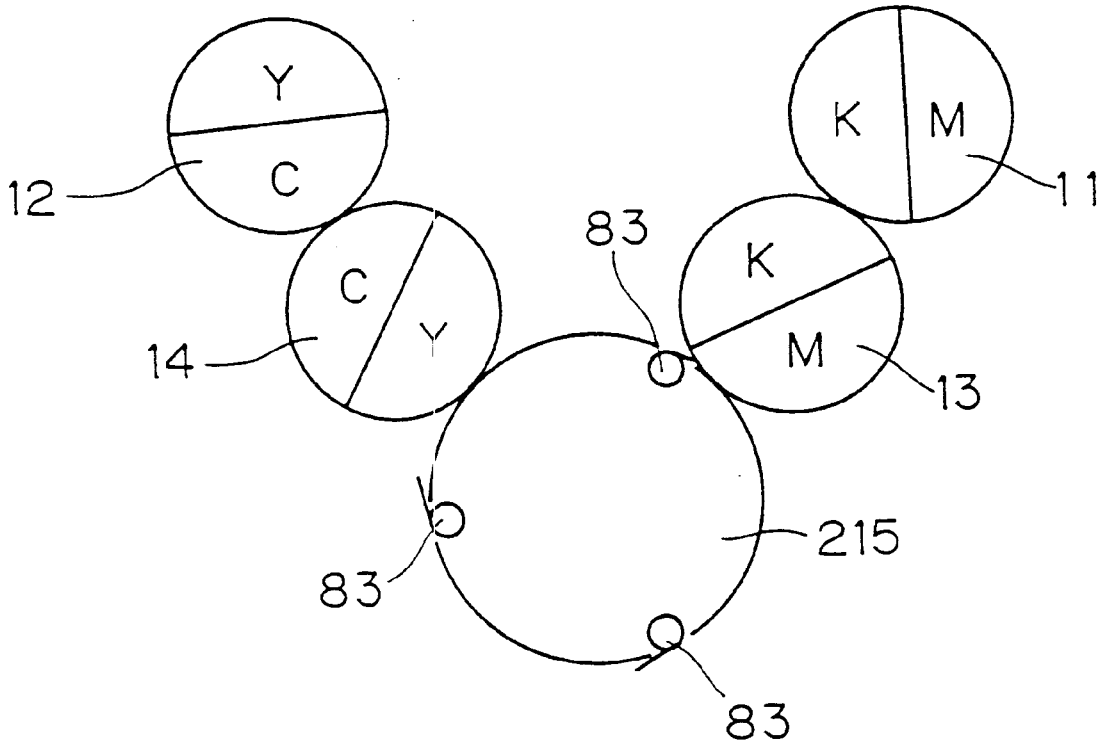
FIG. 26 is an explanatory diagram illustrating the structure of a printing apparatus according to another embodiment of the present invention.

FIG. 26 is an explanatory diagram for illustrating the structure of a printing apparatus according to such an embodiment. This figure illustrates an impression cylinder 215 as well as first and second plate cylinders 11 and 12 and first and second blanket cylinders 13 and 14, which are similar to those of the printing apparatus shown in FIG. 1, in the overall structure of the printing apparatus. The remaining structure is identical to that of the aforementioned printing apparatus shown in FIG. 1.

In to this printing apparatus, the aforementioned natural numbers N and M are assumed to be 1 and 2 respectively. Namely, the diameter of the impression cylinder 215 is 3/2 times that of the first and second plate cylinders 11 and 12 and the first and second blanket cylinders 13 and 14. In this printing apparatus, therefore, the first and second plate cylinders 11 and 12 and the first and second blanket cylinders 13 and 14 rotate three times while the impression cylinder 215 rotates twice. Three grippers 83 are arranged on the outer peripheral portion of the impression cylinder 215 at regular intervals, to be capable of holding three printing-papers S.

In case of performing single-sided four-color printing in this printing apparatus, the impression cylinder 215 holding three printing-papers S rotates twice, for printing the three printing-papers S in four colors of yellow, magenta, cyan and black. Thus, the printing apparatus can continuously execute four-color printing by feeding new three printing-papers S every time the impression cylinder 215 rotates twice.

In case of printing the front surface of each printing-paper S with magenta and cyan inks while printing the rear surface with black and yellow inks, for example, the printing apparatus employs reverse means for the printing-paper S similarly to the printing apparatus shown in FIG. 1. The printing apparatus receives each printing-paper S having the front surface completely printed with the magenta and cyan inks from the impression cylinder 215, reverses this printing-paper S, and the printing-paper S on the impression cylinder 215 is transferred to a position which lags by a distance from the position where the front surface was printed, wherein this distance is 2 (the number of image areas) integral times (preferably a natural number times of 2) the length of the image area (i.e., the length of the printing-paper S). As a result, the rear surface is printed by each plate cylinder, after adding 3 (the number of areas holding the printing-paper S on impression cylinder 215) to 2 integral times of printing, counting from the time the front surface was printed. The numbers 2 (i.e., [2N]) and 3 (i.e., [2M−1]) are even and odd numbers respectively, whereby the printing-paper S comes out of phase so that its rear surface is printed with black and yellow inks.

In this case, the front surface of a second printing-paper S is printed with the black and yellow inks before both surfaces of the first printing-paper S are completely printed. The reversely printed printing-paper S is discarded at need.

Similarly, the diameter of the impression cylinder may be 5/2 or 7/4 times that of the first and second plate cylinders and the first and second blanket cylinders. In the former case, the first and second plate cylinders and the first and second blanket cylinders rotate five times while the impression cylinder rotates twice, for performing single-sided four-color printing or double-sided two-color printing on each of five printing-papers S held on the outer peripheral portion of the impression cylinder. In the latter case, on the other hand, the first and second plate cylinders and the first and second blanket cylinders rotate seven times while the impression cylinder rotates four times, for performing single-sided eight-color printing or double-sided four-color printing on each of seven printing-papers S held on the outer peripheral portion of the impression cylinder.

When [2N+1] image areas are formed on the first and second plate cylinders assuming that N and M represent natural numbers, the diameter of the impression cylinder is set to be [2M/(2N+1)] times that of the first and second plate cylinders and the first and second blanket cylinders. Thus, the impression cylinder rotates [2N+1] times while the first and second plate cylinders and the first and second blanket cylinders rotate [2M] times. The numbers [2N−1] and [2M] are odd and even numbers respectively, whereby [2N+1] images formed on the first and second plate cylinders are transferred to [2M] printing-papers S while the impression cylinder rotates [2N+1] times. Therefore, arranging [2N+1] ink feeders around the first plate cylinder and [2N+1] ink feeders around the second plate cylinder, the printing apparatus can print a single surface of each printing-paper S in [2(2N+1)] colors or both surfaces of each printing-paper S in [2N+1] colors. The ink feeders provided respectively around the first and the second plate cylinders may be less than [2N+1], of course.

Figure 27:
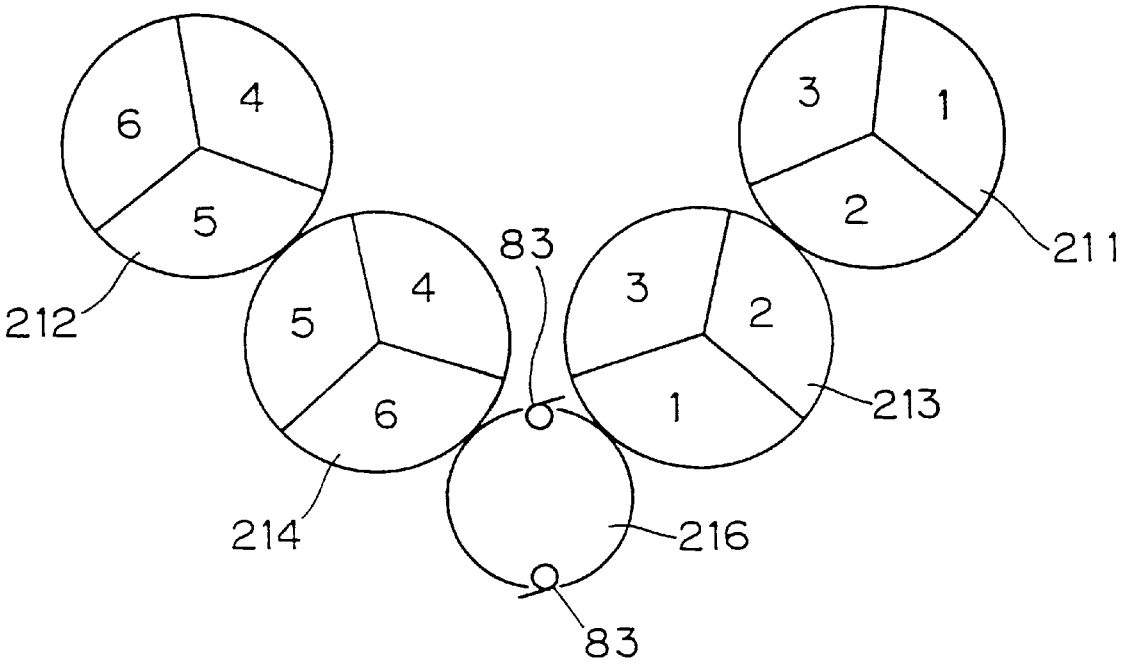
FIG. 27 is an explanatory diagram showing the structure of a printing apparatus according to still another embodiment of the present invention.

FIG. 27 is an explanatory diagram illustrating the structure of a printing apparatus according to such an embodiment. This figure illustrates an impression cylinder 216, first and second plate cylinders 211 and 212 and first and second blanket cylinders 213 and 214 in the overall structure of the printing apparatus. Three ink feeders (not shown) which are similar to the ink feeders 20 shown in FIG. 1 are arranged on an outer side of each of the first and second plate cylinders 211 and 212. The remaining structure is identical to that of the aforementioned printing apparatus shown in FIG. 1.

In this printing apparatus, each of the aforementioned natural numbers N and M is assumed to be 1. Namely, the diameter of the impression cylinder 216 is 2/3 times that of the first and second plate cylinders 211 and 212 and the first and second blanket cylinders 213 and 214 in this printing apparatus. Therefore, the first and second plate cylinders 211 and 212 and the first and second blanket cylinders 213 and 214 rotate twice while the impression cylinder 216 rotates three times. Two grippers 83 are arranged on the outer peripheral portion of the impression cylinder 216 at regular intervals, to be capable of holding two printing-papers S.

In case of performing single-sided six-color printing in this printing apparatus, the impression cylinder 216 holding two printing-papers S rotates three times, for printing the two printing-papers S with one to six color inks. Therefore, the printing apparatus can continuously execute six-color printing by feeding new two printing-papers S from a feed cylinder 16 while the impression cylinder 216 rotates three times. In addition to the general four color inks, inks of other colors called specific colors or transparent varnish may be employed.

In case of printing the front surface of each printing-paper S with four color inks (e.g., two of the first to third colors and two of the fourth to sixth colors) while printing the rear surface with two color inks, for example, the printing apparatus employs reverse means for the printing-paper S similarly to the printing apparatus shown in FIG. 1. Namely, the printing apparatus rotates the impression cylinder 216 for printing the front surface of the printing-paper S with four color inks, then receives the printing-paper S from the impression cylinder 216, reverses the same and the printing-paper S on the impression cylinder 216 is transferred to a position which lags by a distance from the position where the front surface was printed, wherein this distance is 3 (the number of image areas) integral times (preferably a natural number times of 3) the length of the image area (i.e., the length of the printing-paper S). As a result, the rear surface is printed by each plate cylinder, after adding 2 (the number of areas holding the printing-paper S on impression cylinder 216) to 3 integral times of printing, counting from the time the front surface was printed. At this time, the numbers 3 (i.e., [2N+1]) and 2 (i.e., [2N]) are odd and even numbers respectively, whereby the printing-paper S comes out of phase so that its rear surface is printed with two color inks upon single rotation of the impression cylinder 216. The printing apparatus can also print the front and rear surfaces of the printing-paper S in two colors and four colors respectively.

In this case, inks to be originally transferred to the rear surface may be transferred to the front surface of a second or third printing-paper S or printing may be performed on overlapped printing-papers S before the first printing-paper S is completely printed on both surfaces. Such a printing-paper S subjected to abnormal printing is discarded at need.

Similarly, the diameter of the impression cylinder may be 4/3 or 6/5 times that of the first and second plate cylinders and the first and second blanket cylinders. In the former case, the first and second plate cylinders and the first and second blanket cylinders rotate four times while the impression cylinder rotates three times, for performing single-sided six-color printing or double-sided three-color printing on each of four printing-papers S held on the outer peripheral portion of the impression cylinder. In the latter case, on the other hand, the first and second plate cylinders and the first and second blanket cylinders rotate six times while the impression cylinder rotates five times, for performing single-sided ten-color printing or double-sided five-color printing on each of six printing-papers S held on the outer peripheral portion of the impression cylinder.

Suppose the number of printing areas the plate cylinder has (which corresponds to the number of plurality of image areas formed on one printing plate held in the plate cylinder) is X, and the number of printing-paper the impression cylinder can hold is Y, and that X and Y are relatively prime (where they do not have any common measures except for 1). In such a case, if the printing-paper is continuously held in the impression cylinder, soon everything corresponding to all of the image areas will be printed on the printing-paper. Therefore, if the printing-paper can be reversed in an instant without changing the holding position of the printing-paper on the impression cylinder, it is possible to print part of the image areas which is on the above-mentioned plate cylinder to one side of the printing-paper, and the other image areas to the other side of the printing-paper.

In reality, however, it is not easy to reverse the printing-paper in the above-mentioned style. Therefore, in order to obtain the same effect, the printing-paper is returned to the position which lags by N (a natural number) times the length from the outer periphery of the plate cylinder to the position where the printing-paper was taken out of the impression cylinder; that is, the printing-paper returns to the area on the impression cylinder which lags by NX sheets of printing-paper. Consequently, everything corresponding to the image areas is printed on both surfaces of the printing-paper in the same order as in reversing the printing-paper in an instant at the same position on the impression cylinder. The rear surface of the printing-paper is printed after (NX+Y) times of printing, counting from the time the front surface was printed.

Also in each of the embodiments shown in FIGS. 26 and 27, a plurality of images are recorded on uniformly distributed positions for a single plate P held on the outer peripheral portion of each of the first and second plate cylinders 11 and 12 or 211 and 212 for simplifying the apparatus, similarly to the embodiment shown in FIGS. 4 and 5. Alternatively, a plurality of grippers 57 may be arranged on each of the first and second plate cylinders 11 and 12 or 211 and 212 similarly to the embodiment shown in FIG. 6, so that each of the first and second plate cylinders 11 and 12 or 211 and 212 holds a plurality of printing-papers S. Also in this case, the first and second plate cylinders 11 and 12 or 211 and 212 must hold a plurality of plates P in uniformly distributed states, for uniformly distributing the image areas formed on the plates P.

While the invention has been shown and described in detail, the foregoing description is in all aspects illustrative and not restrictive. It is therefore understood that numerous modifications and variations can be devised without departing from the scope of the invention.

We claim:

1. A printing apparatus for printing printing-papers with plates, comprising:

a) a first plate cylinder for holding a first plate, said first plate having a plurality of first printing areas;

b) a second plate cylinder for holding a second plate, said second plate having a plurality of second printing areas;

c) ink application means for applying first and second ink to said first and second plates held on said first and second plate cylinders, respectively;

d) a first blanket cylinder contacting with said first plate cylinder, so that said first ink applied to said first plate is transferred to said first blanket cylinder;

e) a second blanket cylinder contacting with said second plate cylinder, so that said second ink applied to said second plate is transferred to said second blanket cylinder;

f) feed means for feeding a printing-paper to a predetermined position;

g) an impression cylinder for receiving said printing-paper from said feed means at said predetermined position and for impressing a first surface of said printing-paper to said first and second blanket cylinders to transfer said first and second ink onto said first surface of said printing-paper;

h) removal means for removing said printing-paper from said impression cylinder; and i) reverse means for receiving said printing-paper from said removal means, and feeding said printing-paper in reverse state to said feed means.

2. The printing apparatus of claim 1, wherein said reverse means receives said printing-paper after printed by part of said plurality of first printing areas and said plurality of second printing areas, and feeds said printing-paper in reverse state, whereby said printing-paper is further printed by other part of said plurality of first printing areas and said plurality of second printing areas.

3. The printing apparatus of claim 2, wherein number of said plurality of first printing areas is X ($X \geqq 2$, and X is a natural number) and number of said plurality of second printing areas is X, each printing area of said plurality of first printing areas and said plurality of second printing areas having a predetermined size, said impression cylinder has Y (Y is a natural number) holding areas, each of said Y holding areas holding a printing-paper and having said predetermined size, a printing-paper printed by one of said Y holding areas as a original area is removed from said original area, reversed, and fed back to one of said Y holding areas which performs printing after (NX+Y) (N is a natural number) times of printing from said original area, and X and Y are relatively prime.

4. The printing apparatus of claim 1, wherein said first plate has two first printing areas, said second plate has two second printing areas, and said ink application means comprises:

c-1) means capable of applying first part of said first ink to any of said two first printing areas;

c-2) means capable of applying second part of said first ink to any of said two first printing areas;

c-3) means capable of applying first part of said second ink to any of said two second printing areas; and c-4) means capable of applying second part of said second ink to any of said two second printing areas.

5. The printing apparatus of claim 4, wherein said first and second parts of said first ink have different colors CL1 and CL2, said first and second parts of said second ink have different colors CL3 and CL4, each of which is different from said colors CL1 and CL2, and said colors CL1, CL2, CL3, and CL4 are selected from the color group consisting of yellow, magenta, cyan and black.

6. The printing apparatus of claim 1, wherein said first plate cylinder, said second plate cylinder, said first blanket cylinder, and said second blanket cylinder have a first diameter D1, said first plate has 2N first printing areas, said second plate has 2N second printing areas, said impression cylinder has a second diameter D2, and said diameters D1 and D2 are selected such that an equation:

$$D2=\{(2M-1)/2N\}D1$$

is satisfied, where

M and N are natural numbers.

7. The printing apparatus of claim 6, wherein said ink application means comprises:

means capable of applying said first ink to any of said 2N first printing areas; and means capable of applying said second ink to any of said 2N second printing areas, and said impression cylinder holds (2M−1) printing-papers.

8. The printing apparatus of claim 1, wherein said first plate cylinder, said second plate cylinder, said first blanket cylinder, and said second blanket cylinder have a first diameter D1, said first plate has (2N+1) first printing areas, said second plate has (2N+1) second printing areas, said impression cylinder has a second diameter D2, and said diameters D1 and D2 are selected such that an equation:

$$D2=\{2M/(2N+1)\}D1$$

is satisfied, where

M and N are natural numbers.

9. The printing apparatus of claim 8, wherein said ink application means comprises:

means capable of applying said first ink to any of said (2N+1) first printing areas; and means capable of applying said second ink to any of said (2N+1) second printing areas, and said impression cylinder holds 2M printing-papers.

10. The printing apparatus of claim 1, further comprising:

j) reverse control means for intermittently activating said reverse means.

11. The printing apparatus of claim 1, wherein said removal means comprises a removal cylinder having a gripper for holding one edge of said printing-paper from said impression cylinder, and said reverse means comprises a reverse cylinder having a gripper for holding an opposite edge of said printing-paper from said removal cylinder.

12. The printing apparatus of claim 11, wherein said feed means comprises a feed cylinder having a gripper for holding said opposite edge of said printing-paper from said reverse cylinder, and said feed cylinder feeds said printing-paper to said impression cylinder.

13. The printing apparatus of claim 1, wherein said first plate consists of a plurality of first pieces, each of said plurality first pieces corresponds to one of said plurality of first printing areas, said second plate consists of a plurality of second pieces, and each of said plurality second pieces corresponds to one of said plurality of second printing areas.

14. A printing apparatus for printing printing-papers with a plate, comprising:

a plate cylinder having at least two printing regions, said plate cylinder holding a plate;

at least two ink applicators each of which applies ink of a different color from others to a part of said plate, said part of said plate corresponding to one of said at least two printing regions;

a blanket cylinder receiving ink from said plate by contacting with said plate held on said plate cylinder, said blanket cylinder having same number of transferring regions as said at least two printing regions;

a impression cylinder holding at least one printing-paper, said at least one printing-paper receiving ink from said blanket cylinder by contacting with said blanket cylinder, number of said at least of one printing-paper and number of said at least two printing regions being relatively prime; and a reverse mechanism removing one of said at least one printing-paper as a reversing-paper from said impression cylinder, reversing said reversing-paper, and feeding said reversing-paper back to said impression cylinder.

15. The printing apparatus of claim 14, wherein said reverse mechanism receives said reversing-paper after printed by part of said at least two printing areas, and feeds said reversing-paper in reverse state, whereby said reversing-paper is further printed by other part of said at least two printing areas.

16. The printing apparatus of claim 15, wherein said plate held on said plate cylinder has X ($X \geqq 2$, and X is a natural number) printing areas, each of said X printing areas having a predetermined size, said impression cylinder has Y (Y is a natural number) holding areas, each of said Y holding areas having said predetermined size, a printing-paper printed by one of said Y holding areas as a original area is removed from said original area, reversed, and fed back to one of said Y holding areas which performs printing after (NX+Y) (N is a natural number) times of printing from said original area, and X and Y are relatively prime.

17. The printing apparatus of claim 16, wherein a path along which said reverse mechanism transfers said printing-paper has a length obtained by multiplying said predetermined size by a natural number.

18. The printing apparatus of claim 14, wherein said plate consists of a plurality of pieces, and each of said plurality of pieces corresponds to one of said at least two printing regions.

19. A printing apparatus for printing printing-papers with plates, comprising:

(a) at least two mechanisms for transferring ink, each of said at least two mechanisms comprising:

(a-1) a plate cylinder having at least two printing regions, said plate cylinder holding a plate;

(a-2) at least two ink applicators each of which applies ink of a different color from others to a part of said plate, said part of said plate corresponding to one of said at least two printing regions, number of said at least two ink applicators being same as number of said at least two printing regions of said plate cylinder; and (a-3) a blanket cylinder receiving ink from said plate by contacting with said plate held on said plate cylinder, said blanket cylinder having same number of transferring regions as said at least two printing regions;

(b) a impression cylinder holding at least one printing-paper, said at least one printing-paper receiving ink from said blanket cylinder by contacting with said blanket cylinder, number of said at least of one printing-paper and number of said at least two printing regions being relatively prime; and (c) a reverse mechanism removing one of said at least one printing-paper as a reversing-paper from said impression cylinder, reversing said reversing-paper, and feeding said reversing-paper back to said impression cylinder.

20. The printing apparatus of claim 19, wherein each of said at least two ink applicators is selectively operable to apply ink toward any of said at least two printing regions of said plate cylinder corresponding to said at least two ink applicators.

* * * * *